US005605243A

United States Patent [19]

Jolly

[11] Patent Number: 5,605,243

[45] Date of Patent: Feb. 25, 1997

[54] FLOATING ROOF

[75] Inventor: Ronald P. Jolly, Magnolia, Tex.

[73] Assignee: HMT, Inc., Houston, Tex.

[21] Appl. No.: 630,270

[22] Filed: Apr. 10, 1996

Related U.S. Application Data

[63] Continuation of Ser. No. 313,000, Sep. 27, 1994, abandoned, which is a continuation-in-part of Ser. No. 62,006, May 14, 1993, Pat. No. 5,533,640.

[51] Int. Cl.[6] ..... B65D 88/34

[52] U.S. Cl. ..... 220/216

[58] Field of Search ..... 220/216, 218, 220/221, 222

[56] References Cited

U.S. PATENT DOCUMENTS

| | | | |
|---|---|---|---|
| Re. 24,133 | 3/1956 | Bloedow . | |
| 1,308,168 | 7/1919 | Courvoisier . | |
| 1,513,043 | 10/1924 | Huff . | |
| 2,036,372 | 4/1936 | Stough . | |
| 3,730,122 | 5/1973 | Odum et al. . | |
| 3,861,555 | 1/1975 | Nelson . | |
| 4,092,790 | 6/1978 | Sonerud . | |
| 4,243,151 | 1/1981 | Bruening . | |
| 4,244,487 | 1/1981 | Kern . | |
| 5,005,724 | 4/1991 | Imhof | 220/216 X |
| 5,078,293 | 1/1992 | Lippiello | 220/221 |
| 5,372,270 | 12/1994 | Rosenkrantz | 220/221 X |

FOREIGN PATENT DOCUMENTS

| | | | |
|---|---|---|---|
| 405077882 | 3/1993 | Japan | 220/216 |

*Primary Examiner*—Jes F. Pascua

*Attorney, Agent, or Firm*—Loeb & Loeb LLP

[57] ABSTRACT

A floating roof for use in a storage tank for liquid petrochemical products has a frame comprised of girders having grooved slots in top and opposite side surfaces thereof along substantially the entire lengths of the girders. The slots are capable of receiving threaded fasteners and flanges at any location along the length thereof, permitting cross girders to be bolted to main girders at virtually any location along the length of the main girder and deck sheeting to be bolted to the tops of the girders at virtually any location along the length of each girder, without the need to drill holes. Adjustable legs for supporting the floating roof on the bottom of the storage tank and which are internally sealed against vapor leakage, are mounted on the girders and are coupled to the junction of a main girder and a cross girder by a sealed support housing assembly. A manway assembly and bleeder vent assemblies are also coupled to girder junctions. The bleeder vent assemblies include well support angles mounted on opposite pairs of spaced-apart girders together with a bleeder guide assembly which supports a leg. A deck drain includes a check valve permitting rain water and other liquids which may accumulate on the deck to drain, and seals to prevent escape of vapors when liquid is not present. The floating roof includes pontoons, each of which is coupled to the girders or the curved outer rim of the floating roof by saddle and strap arrangements.

3 Claims, 21 Drawing Sheets

FLOATING ROOF

CROSS-REFERENCE TO RELATED APPLICATION

This is a continuation of application Ser. No. 08/313,000 filed on Sep. 27, 1994, now abandoned, which is a continuation-in-part of Ser. No. 08/062,006 of Ronald P. Jolly, filed May 14, 1993 now U.S. Pat. No. 5,533,640, and entitled "Floating Roof".

BACKGROUND OF THE INVENTION

1. Field of the Invention

The present invention relates to floating roofs for use in storage tanks for oil or other liquid petrochemical products.

2. History of the Prior Art

Storage tanks for oil and other liquid petrochemical products are typically provided with a floating roof. The floating roof floats on the liquid product and seals the tank to prevent the escape of harmful vapors when provided with one or more seals extending between the outer periphery of the floating roof and the inner wall of the tank.

Such floating roofs are usually circular in shape and of relatively thin, generally planar configuration. The roofs may assume a number of different basic forms. One particular type of floating roof, which is popular because it lends itself to lightweight construction using aluminum and other relatively lightweight materials, consists of a frame or deck supported by pontoons mounted at the underside thereof. The frame is typically comprised of an outer circular frame member and a plurality of beams or girders disposed therein and attached thereto. The girders, which are typically of aluminum construction, are arranged into a grid pattern of spaced-apart, parallel main girders and cross girders to provide the floating roof with adequate strength and rigidity while at the same time minimizing the weight of the roof. The pontoons are coupled to support legs mounted at the underside of the floating roof. Deck sheeting in the form of sheets of aluminum or other lightweight material is secured over the girders to provide the floating roof with a top surface.

An example of a prior art floating roof of the type described is provided by U.S. Pat. No. 4,244,487 of Kern, which patent issued Jan. 13, 1981 and is entitled "Floating Cover Having Pivotally Connected Flotation Pontoons". In the floating roof described in the Kern patent, a plurality of support legs are mounted at the underside of a sheet metal decking and are coupled to flanges extending from the opposite ends of a plurality of pontoons. Other support legs are mounted by coupling to pivotal interconnections of flanges extending from the ends of adjacent pontoons. The pontoons are coupled to the sheet metal decking by one of a pair of opposite beams, which sandwich overlapping deck sheets therebetween using bolts as fasteners.

A major problem with floating roofs of the type described in the Kern patent relates to the fact that the pontoons are joined together, end-to-end, as well as to the support legs. This results in considerable stress being placed on the pontoons, which must function as main structural beams. Because of the design of the floating roof deck, such deck is incapable of providing much support for the pontoons or for the support legs. Moreover, the pontoons must provide primary support for the support legs, which are only minimally supported by the deck in cases where they are attached to the deck or not at all in other cases. To prevent rupture of the flanges welded to caps at the ends of the pontoons, particularly under conditions of cyclic loading such as may be due to turbulence in the liquid product, the pontoons are pivotally coupled to the opposite end flanges. Because the overlapping sheet metal decking is clamped by bolts extending through the opposite beams, such bolts penetrate the vapor space above the liquid product in the tank and pose a leakage problem if the bolts are not sealed or become loose.

A further problem in the construction of those prior art floating roofs which employ a grid of girders in the deck thereof relates to the substantial nature of the grid network formed by the girders. Because such roofs typically have a diameter of 50 feet or more, the deck frame thereof may require assembly of many main girders and cross girders. Attachment of such girders requires that many holes be drilled so that the girders can be bolted or otherwise joined together. This is typically a very time consuming process. Moreover, once girders are joined at a particular location, they cannot be adjusted or relocated without drilling more holes. The deck sheeting is typically mounted on the frame or deck by bolting to the girders, again requiring that more holes be drilled. Because such holes extend through the girders to the underside of the floating roof, they pose a problem of leakage, even after bolts are secured therein to mount the deck sheeting thereon. Such leakage not only causes air pollution but also results in loss of the liquid product which can represent a financial loss as well.

Floating roofs of the type described must be provided with a plurality of support legs at the underside thereof. Such support legs contact the bottom of the tank to hold the floating roof above the bottom when the tank is empty or nearly empty of liquid product. This prevents the floating roof itself from resting on the tank bottom, with possible damage to the pontoons or other portions of the floating roof. The legs are typically adjustable in order to compensate for non-level tank bottoms. The legs are adjusted during a levelling process before the tank is filled with liquid product. Typically, the leg assemblies are coupled to the ends of the pontoons and derive their major support therefrom, as in the case of the Kern patent described above. Although the leg assemblies may also be coupled to the deck sheeting, most of the support typically comes from the flanges which extend from end caps at the opposite ends of the pontoons to support the leg assemblies. This results in considerable stress on the flanges, the end caps and the pontoons themselves.

Floating roofs of the type described are desirably provided with means for venting the underside of the roof when it is adjacent the bottom of the tank. Normally, the floating roof must maintain an airtight seal, to prevent the escape of harmful vapors. However, venting of the floating roof when it is resting on the tank bottom allows air which may accumulate at the underside of the floating roof to escape, while at the same time breaking or venting a vacuum which may occur at the underside of the roof. The air build up and vacuum may occur when filling of the tank with liquid product is begun, or when the liquid product is being drained from the tank.

In floating roofs of the type described, it is desirable to provide the roof with a drain for rain water and other liquids which may accumulate on the deck of the roof. However, the drain should not allow vapors to escape from the underside of the floating roof to the atmosphere above.

In floating roofs of the type described, the pontoons may be coupled to the underside of the frame by arrangements which employ an elongated metal strap in conjunction with a two-piece saddle and a saddle bar. The saddle bar, which is placed inside the girder, is required in order to determine the positions of opposite portions of the two-piece saddle which receive and support the pontoon. Opposite ends of the strap are bolted through the opposite portions of the two-piece saddle to the opposite ends of the saddle bar within the girder, to secure the metal strap and the two-piece saddle in place at the underside of the girder.

In floating roofs of the type described, the opposite ends of each pontoon are typically provided with end caps which are welded in place thereon to secure the end caps to the hollow tubes forming the pontoons. The welding must be done carefully in order to make the pontoons airtight and liquidtight and at the same time make the pontoons capable of supporting the legs via flanges attached to the end caps. Because the end caps are placed over the open ends of the pontoons for welding, the welding process is made difficult. Moreover, the strength requirements imposed on the pontoons and on the end caps thereof, due to the coupling of the legs thereto, are substantial.

Accordingly, it would be desirable to provide a floating roof having pontoons which are not joined together and which are not required to support legs or other appendages to the roof. Without the pontoons having to function as main structural beams, the pontoons need not be joined together, and rigid joint connections to the pontoons can be eliminated. It would furthermore be desirable to provide a floating roof in which the support legs are supported entirely by the deck frame and which, in any event, do not require the pontoons for their support. Among other things, this would eliminate the problem of fatigue at the very critical connection point of the leg to the pontoon, with resulting leakage in the pontoon. It would still furthermore be desirable to provide a floating roof in which the sheet metal decking is mounted to the deck frame by an arrangement which does not penetrate the vapor space below and therefore poses no danger of leakage, such as may be caused by loosening of the connecting bolts or the corrosion of such bolts when exposed to the vapors.

Accordingly, it would be desirable to provide a floating roof in which girders within the frame or deck can be easily coupled to one another at any of a variety of locations along the lengths thereof and in which the deck sheeting can be mounted thereon, without the need for drilling holes. Such floating roof should be capable of coupling the support legs to the girders, so that the legs do not have to support the pontoons. Moreover, the design of the floating roof should provide considerable flexibility in terms of where the legs can be mounted. The design of the floating roof should also allow manway assemblies, bleeder vent assemblies, liquid drains, and other required roof penetrations, to be easily and simply mounted in any one of a variety of different locations throughout the floating roof. The pontoons should be capable of mounting at the underside of the girders or the circular outer rim of the floating roof using simplified mounting arrangements. The end caps of the pontoons should desirably be designed to facilitate the process of welding them to the opposite ends of the pontoons to achieve the water-tight seal, while at the same time enhancing the structural integrity of the hollow cylindrical configuration of the pontoons.

BRIEF DESCRIPTION OF THE INVENTION

The foregoing and other objects and features in accordance with the invention are accomplished by providing an improved floating roof having a frame or deck comprised of a circular outer frame and a plurality of girders disposed within and coupled to the circular frame. The girders include main girders extending between the circular outer frame in spaced-apart, generally parallel fashion and cross girders which extend between and are coupled to adjacent pairs of the main girders. Deck sheeting is disposed over the girders to provide the top surface for the frame. A plurality of pontoons are coupled to the underside of the frame, and a plurality of support legs are coupled to the girders of the frame.

In accordance with the invention, the girders have top surfaces and opposite side surfaces which are provided with grooved slots extending along essentially the entire lengths of the girders. A threaded fastening device such as a bolt can be secured within the grooved slots at virtually any location along the length of the grooved slot. This enables the cross girders to be coupled to the main girders at virtually any location along the lengths of the main girders. Such coupling is accomplished using mounting angles which are angled through an approximately 90° or right angle bend together with threaded fasteners inserted through the mounting angles and into the grooved slots in the side surfaces of the girders. The deck sheeting may be mounted on the girders without drilling holes in the girders or otherwise risking the escape of vapors by penetrating the girders. This is accomplished by threaded fasteners such as bolts which extend through girder caps disposed on the deck sheeting opposite the top surfaces of the girders. The bolts extend through the deck sheeting and into the grooved slots in the top surfaces of the girders where they are secured to mount the deck sheeting.

The grooved slots in the opposite side surfaces of the girders are also capable of receiving the flanges of coupling devices at virtually any location along the length of the girder, to facilitate coupling of the girder to other girders as well as coupling of other members such as support legs and pontoons to the girder. The mounting angles are provided with flanges which are inserted into the slots in the sides of the main and cross girders at the junction thereof, together with the threaded fasteners, to provide a stable and rigid coupling of the main and cross girders. In accordance with the invention, two girders can be spliced end-to-end using opposite splice plates having flanges which are inserted into the slots in the opposite sides of the girders together with threaded fasteners. Still other plates have lateral flanges which can be installed in the slots in the sides of the girders, together with threaded fasteners, to provide a means for coupling members such as support legs and pontoons to the girders.

The circular outer rim of the floating roof may comprise a plurality of spliced-together rim channel sections. To prevent leakage of vapors from the liquid product through the rim channel splices, a rim splice plate may be coupled to adjoining portions of the adjacent rim channel sections so as to span the joint therebetween. The joint may then be filled with caulking or other sealant. The rim splice plate maintains the rim channel sections in a desired positional relationship so that the caulking remains intact within the joint and continues to seal the joint.

In accordance with the invention, support legs for the floating roof are coupled to the girders and not to the pontoons. Each support leg is preferably coupled to the junction of a main girder and a cross girder by a support housing assembly coupled to the main girder and to the cross girder. The support housing assembly includes a mounting angle disposed over the side surfaces of the main and cross girders and having lateral flanges and bolts or other threaded fasteners extending into the grooved slots in the side surfaces of the main and cross girders. The mounting angle is coupled to a top plate which surrounds a support housing top assembly for the leg. The mounting angle has a lower flange which is spaced from the top plate and is coupled to the support housing top assembly. A circular flange mounted on the support housing top assembly above the upper plate is bolted to the upper plate to couple the support housing top assembly thereto. The support housing top assembly contains the leg in the form of a support tube slidably positioned therein so that the length thereof can be adjusted.

To prevent vapors from the liquid product beneath the floating roof from leaking through the space between the inner surface of the support housing top assembly and the adjacent outer surface of the support tube to the atmosphere above, a gasket may be placed between the circular flange and the top plate so as to extend between upper and lower portions of the support housing top assembly and into contact with the outer surface of the support tube. Vapors entering the hollow interior of the support tube through an aperture in the side of the support tube may be prevented from escaping by disposing an elastomeric cup-shaped piston seal within the hollow interior of the support tube above the aperture.

In accordance with the invention, a manway assembly is mounted on the frame or deck of the floating roof at a location having a first pair of spaced-apart, parallel girders and a second pair of girders disposed in spaced-apart, generally parallel relation so as to extend between and form generally right angles with the first pair of girders. The second pair of girders can be positioned at virtually any location along the lengths of the first pair of girders because of the grooved slots along the side surfaces of the first pair of girders. The second pair of girders are coupled thereto using flanged mounting angles and threaded fasteners. The first and second pairs of girders form a rectangular opening in the frame, which opening extends up through the deck sheeting to form a well. The well is partially formed by four different well support angles which are mounted over and secured to the top surfaces of the first and second pairs of girders by threaded fasteners driven into the grooved slots in such top surfaces.

Further in accordance with the invention, a bleeder vent assembly is mounted on the frame or deck of the floating roof using pairs of the girders to frame the assembly and form a well opening therein. The bleeder vent assembly includes an adjustable leg in the form of a support tube adjustably positioned within a support tube sleeve assembly. The support tube sleeve assembly is coupled by a bleeder guide assembly to a pair of girders. The bleeder guide assembly consists of flanges coupled to and extending from opposite sides of the support tube sleeve assembly to the side surfaces of the first pair of girders where they are secured using threaded fasteners. A bleeder cover mounted on the upper end of the support tube assembly normally resides over the top of the well formed by four well support angles to maintain the seal of the frame. However, as the floating roof is lowered so that the support tube assembly comprising the leg contacts the bottom of the tank, the support tube assembly is raised within the support tube sleeve assembly so as to raise the bleeder cover above the well opening and thereby vent the underside of the floating roof.

Still further in accordance with the invention, a deck drain may be mounted on the deck so as to drain liquid such as rain water which may accumulate on the deck while at the same time preventing vapors from the liquid product below the deck from escaping therethrough to the atmosphere above. The deck drain includes a check valve above the deck which is coupled to a drain tube extending downwardly from the deck. The check valve includes an open cage extending upwardly from the deck and having an elastomeric ball slidably disposed therein. When liquid accumulates on the deck, the buoyancy of the ball causes it to rise within the cage, allowing the liquid to flow into the upper open end of the drain tube for removal from the deck. At all other times, gravity positions the ball at the bottom of the cage where it resides within and seals off the upper open end of the drain tube and prevents the passage of vapors therethrough.

In accordance with the invention, the pontoons, which are not coupled to each other or to the legs, are coupled to the undersides of the girders of the frame using mounting arrangements which include an elongated metal strap and a saddle consisting of a single, integrally formed member having an intermediate cradle portion between opposite ends. The cradle portion is in the shape of a circular arc so as to receive therein a top portion of the pontoon. The saddle is coupled to the bottom of a girder. The elongated metal strap extends around the pontoon so that the opposite ends thereof are disposed adjacent the opposite ends of the saddle, and are coupled to the opposite ends of the saddle by bolts. In one embodiment, each of a pair of bolts extends downwardly through a bar disposed within and spanning a slot at the bottom of the girder so as to secure the bolt within the girder. The bolt extends through an aperture in the associated end of the saddle and an aperture in the associated end of the elongated metal strap, where it receives a pinch washer and a nut. In an alternative embodiment, the saddle and strap are bolted to opposite ends of a flange at the lower edge of a mounting plate. A lateral flange at an intermediate location on the opposite side extends into the slot in the side of a girder, together with threaded fasteners, to securely fasten the mounting plate to the girder. In a further alternative embodiment, the saddle and strap are attached by a single bolt or other pivotable fastener to a flange at the lower end of a mounting plate attached to the girder. This permits the pontoon to assume any angular position relative to the girder.

In accordance with the invention, each pontoon is comprised of a hollow, generally cylindrical tube having a pair of end caps mounted within the opposite open ends thereof. Each end cap consists of a relatively flat, circular member of generally planar configuration terminating at the outer periphery thereof in a flange which extends outwardly from the plane of the cap. The end cap is mounted within the open end of the pontoon tube so as to be recessed inwardly and with the flange thereof disposed against an inner surface of the tube adjacent the open end of the tube. The flange is then welded to the end of the tube to form an airtight and liquidtight seal. Such arrangement facilitates the welding process. At the same time, disposition of the end caps in a recessed position with the outer flange thereof extending around and contacting the inner surface of the pontoon tube acts to support and maintain the cylindrical configuration of the pontoon tube.

In accordance with the invention, pontoons may be mounted on the circular outer rim of the floating roof by a non-welded arrangement which utilizes saddles and straps at the opposite ends of each pontoon. The opposite ends of each strap are secured to the opposite ends of an adjacent saddle. Each saddle is coupled to a bracket secured to the rim channel sections, which comprise the circular outer rim of the floating roof, by upper and lower bolts. This allows the bracket to assume a desired angular orientation to the rim channel sections.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
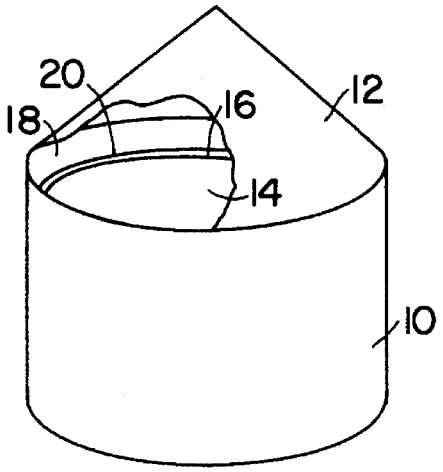
FIG. 1 is a perspective view, partly broken away, of an oil storage tank having a floating roof in accordance with the invention.

FIG. 1 depicts a storage tank 10 which is of the enclosed type so as to have an overhead roof 12. A floating roof 14 in accordance with the present invention is disposed beneath the overhead roof 12 and floats on top of a liquid product such as oil stored within the tank 10. To prevent hydrocarbon vapors from escaping into the atmosphere from the space between an outer rim 16 of the floating roof 14 and an inner tank wall 18, a seal 20 is provided. The seal 20 extends around the outer rim 16 of the floating roof 14 and the inner tank wall 18 and acts as a barrier to hydrocarbon vapors. The seal 20 must be capable of movement up and down the inner tank wall 18 while maintaining a sealing relationship therewith, so that the floating roof 14 may rise or fall with the varying quantities of the liquid product in the tank.

Figure 2:
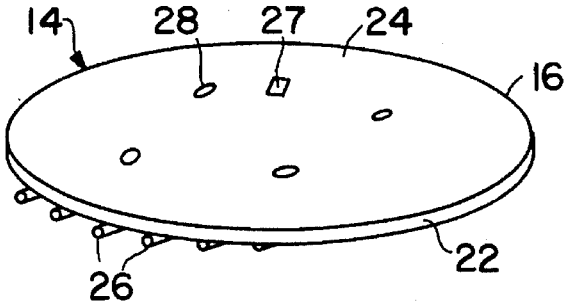
FIG. 2 is a perspective view of the floating roof of the storage tank of FIG. 1.

FIG. 2 shows the floating roof 14. The floating roof 14 is basically comprised of a frame or deck 22 which is described in detail hereafter in connection with FIG. 3. The frame 22 is covered with deck sheeting 24 to provide a top surface which seals the floating roof 14. Mounted at the underside of the frame 22 are a plurality of pontoons 26, enabling the roof 14 to float on the liquid product within the storage tank 10. The floating roof 14 is provided with at least one manway assembly 27, providing worker access to the underside of the floating roof 14. The manway assembly 27 is described in detail hereafter in connection with FIGS. 14–16. The floating roof 14 is also provided with a plurality of bleeder vent assemblies 28, which are described in detail hereafter in connection with FIGS. 17 and 18. The bleeder vent assemblies 28 open to vent the underside of the floating roof 14 to the atmosphere above when the tank 10 is being filled with liquid product or emptied of liquid product. The bleeder vent assemblies 28 allow air and gases which may accumulate at the underside of the floating roof 14 to escape to the atmosphere above. The bleeder vent assemblies 28 also serve to break any vacuum which may be created beneath the floating roof 14 during filling or emptying of the storage tank 10.

Figure 3:
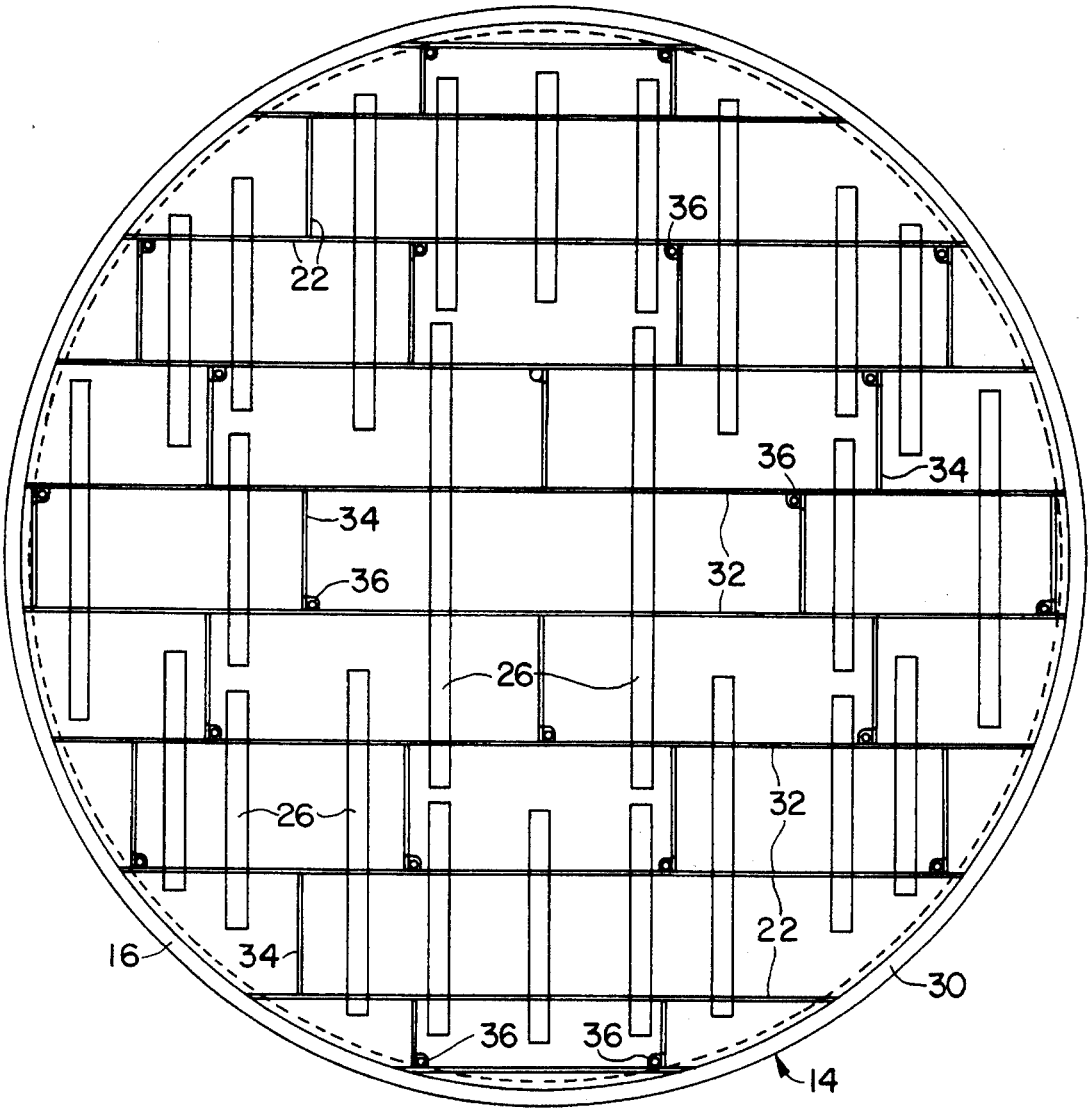
FIG. 3 is a top or plan view of the floating roof of FIG. 2, with the deck sheeting removed to show the arrangement of girders, pontoons and support legs therein.

FIG. 3 shows the floating roof 14 with the deck sheeting 24 removed so that the internal details of the floating roof can be seen. The frame 22 includes a channel 30 which is rolled to the radius of the floating roof 14 so as to define the outer periphery of the frame 22. The frame 22 also includes a plurality of main girders 32 extending in a common direction so as to be spaced-apart from and generally parallel to each other. The main girders 32 extend between opposite portions of the channel 30. The frame 22 also incudes cross girders 34, each of which extends between an adjacent pair of the main girders 32. The cross girders 34 are disposed so as to be generally parallel with the pontoons 26. The cross girders 34 are also located in areas where support leg assemblies 36 are mounted on the frame 22. As described hereafter in connection with FIGS. 9 and 10, each support leg assembly 36 is coupled to the junction of a main girder 32 and a cross girder 34. The cross girders 34 are also located where the manway assembly 27 and the bleeder vent assemblies 28 are mounted.

As seen in FIG. 3, the pontoons 26 are mounted so as to extend transversely across the main girders 32 and form generally right angles therewith. As described hereafter, each of the pontoons 26 is coupled to a plurality of the main girders 32. Most of the pontoons 26 extend along a common line with other pontoons. The facing ends of adjacent pontoons 26 within a line of the pontoons 26 are spaced-apart from each other, as shown in FIG. 3. As also described hereafter in connection with FIGS. 32–34, pontoons such as the pontoons 26 can also be mounted on the channel 30 to provide buoyant support for the outer rim of the floating roof 14.

In accordance with the invention, and as described hereafter in connection with FIGS. 4–9, the main girders 32 and the cross girders 34 are provided with grooved slots along the lengths thereof. Such grooved slots are capable of receiving flanges as well as threaded fasteners such as bolts at virtually any location along the lengths of the main girders 32 and each of the cross girders 34. This allows the cross girders 34 to be coupled to the main girders 32, and the main girder 32 to be spliced to each other, without the need for drilling holes. In particular, however, it provides great flexibility in assembling the floating roof 14 inasmuch as the cross girders, for example, can be located at virtually any desired location along the length of the main girder 32, again without the need to drill holes. Also, the support leg assemblies 36 can be mounted in virtually any desired location within the floating roof 14, again without the need to drill holes. Similar comments apply to the location and mounting of the manway assembly 27 and the bleeder vent assemblies 28.

As described in detail in connection with FIGS. 4–9, each of the main girders 32 and each of the cross girders 34 has a top surface provided with a grooved slot, and opposite side surfaces, each of which is provided with a grooved slot. The grooved slots in the top surfaces of the girders 32 and 34 facilitate mounting of the deck sheeting 24, by enabling threaded fasteners to be inserted into the grooved slots at virtually any desired location along the lengths of the girders 32 and 34. Because such threaded fasteners do not penetrate the girders 32 and 34, but merely reside within the grooved slots in the top surfaces thereof, accidental leakage of vapors around such fasteners is prevented. The grooved slots in the opposite side surfaces of the girders 32 and 34 facilitate mounting of the cross girders 34 at virtually any location along the lengths of the main girders 32. The grooved slots in the side surfaces also allow for the support leg assemblies 36 and the bleeder vent assemblies 28 to be located at virtually any desired location along the length of the main girders 32.

Figure 4:
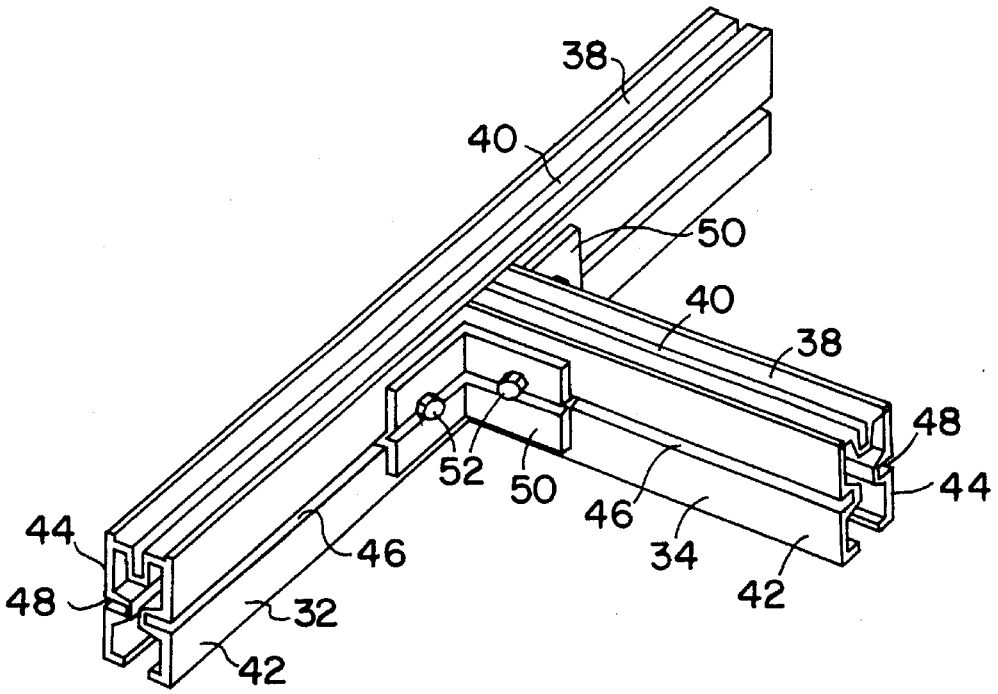
FIG. 4 is a perspective view of portions of a main girder and a cross girder of the arrangement of FIG. 3, showing the manner in which such girders are connected in accordance with the invention.

FIG. 4 shows a portion of a main girder 32 with a portion of a cross girder 34 coupled thereto to form a generally right angle joint therewith. Each of the girders 32 and 34 has a top surface 38 with a grooved slot 40 centrally disposed along the length thereof. Each of the girders 32 and 34 also has opposite side surfaces 42 and 44 which are respectively provided with centrally located grooved slots 46 and 48 respectively extending along the lengths of the girders 32 and 34.

The grooved slots 40, 46 and 48 which extend along the lengths of the girders 32 and 34 are capable of receiving flanges and threaded fasteners such as bolts at virtually any location along the lengths of such slots. This enables the girders 32 and 34 to be coupled together at virtually any location along the main girder 32. In addition, and as described hereafter, the support leg assemblies 36, the manway assembly 27 and the bleeder vent assemblies 28 can be coupled at virtually any location along the lengths of the main girders 32 within the frame 22 of the floating roof 14. Again, the drilling of holes is eliminated by use of the grooved slots 40, 46 and 48.

Figure 5:
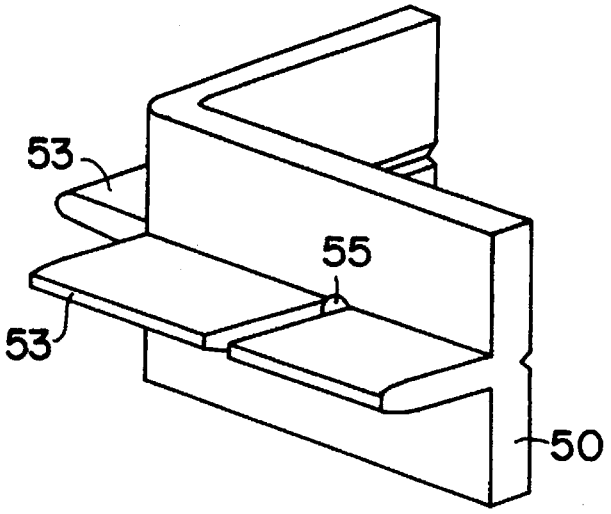
FIG. 5 is a perspective view of one of a pair of mounting angles used in the arrangement of FIG. 4.

As shown in FIG. 4, the cross girder 34 is coupled to the main girder 32 by an opposite pair of mounting angles 50 which undergo generally right angle bends. The mounting angles 50 are secured to the main girder 32 and to the cross girder 34 by threaded fasteners in the form of bolts 52. Within each mounting angle 50, one of the bolts 52 extends into the grooved slot 46 in the side surface 42 of the main girder 32. Another bolt 52 extends through the mounting angle 50 and into the grooved slot 46 in the side surface 42 of the cross girder 34. As best shown in FIG. 5, each mounting angle 50 has a pair of flanges 53 extending laterally from intermediate portions of each of the 90° angled portions. The flanges 53 are forced into the slots 46 in the main girder 32 and the cross girder 34, where they reside with a force fit to provide the joint formed by the girders 32 and 34 with integrity and rigidity. A hole 55 for accommodating each of the bolts 52 is drilled through each of the two angled portions of the mounting angle 50 and through the flanges 53 at the back thereof so as to form a slot in each of the flanges 53.

Figure 6:
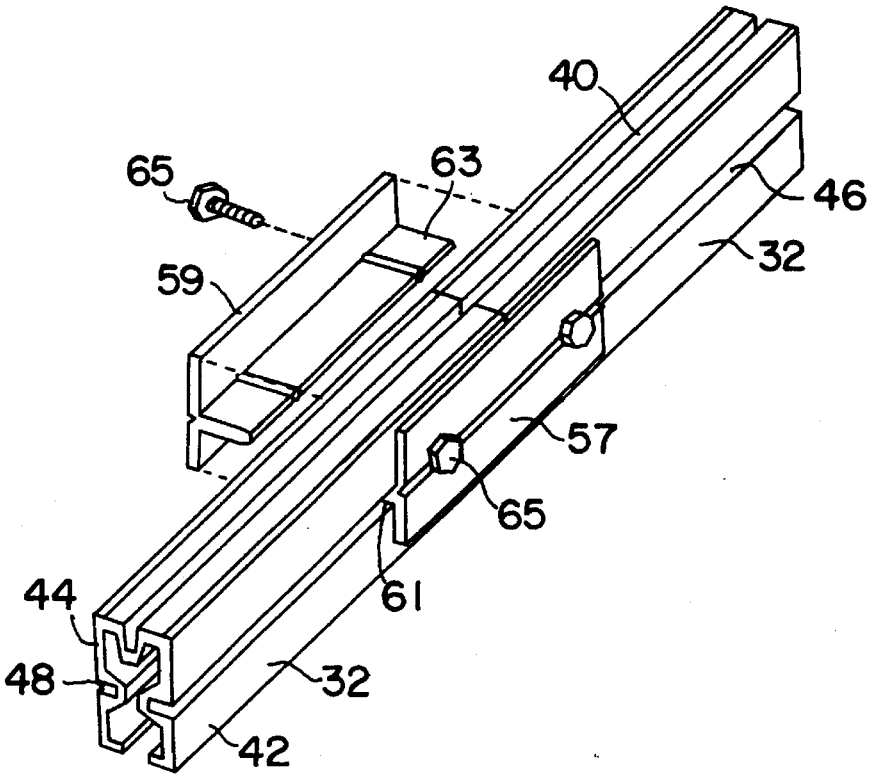
FIG. 6 is a perspective view of a pair of girders showing the manner in which they can be spliced together in accordance with the invention.

FIG. 6 illustrates the manner in which two main girders 32 can be spliced together, end-to-end, in accordance with the invention. Opposite splice plates 57 and 59 have lateral flanges 61 and 63 respectively which are inserted in the opposite slots 46 and 48 of the girders 32. The splice plates 57 and 59 are held in place by threaded fasteners in the form of bolts 65 inserted through apertures in the splice plates 57 and 59 and into the slots 46 and 48. The splice plates 57 and 59 hold the opposite girders 32 securely together, while the disposition of the flanges 61 and 63 in the slots 46 and 48 maintains alignment of the girders 32.

Figure 7:
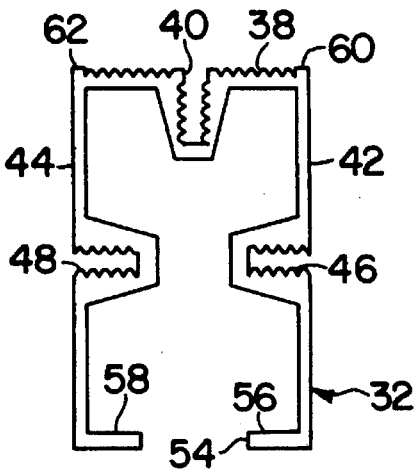
FIG. 7 is an end view of one of the girders of the arrangement of FIG. 4.

FIG. 7 is an end view of the main girder 32 of FIG. 4. However, the end view of FIG. 7 also applies to the cross girder 32, inasmuch as the girders 32 and 34 are of like cross-sectional configuration. The girder 32 is integrally formed, such as by extrusion, from a relatively lightweight and yet strong material such as aluminum. The girder 32 has a hollow interior which opens to the outside of the girder through a slot 54 in the bottom of the girder 32. The slot 54 is defined by opposite legs 56 and 58 of the girder body. The top surface 38 of the girder 32 is grooved and is provided with small ridges 60 and 62, which extend along the top surface 38 at opposite sides thereof.

Figure 8:
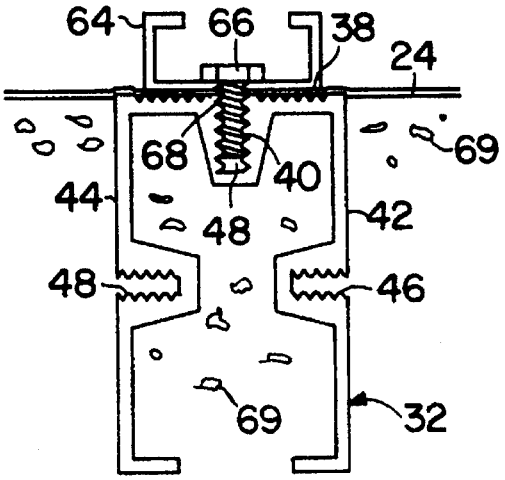
FIG. 8 is an end view of a girder, similar to the view of FIG. 7, and showing the manner in which a girder cap and threaded fasteners are used to secure deck sheeting to a top surface of the girder.

FIG. 8 illustrates the manner in which the deck sheeting 24 is secured to the top surfaces 38 of the girders 32 and 34. With the deck sheeting 24 placed over the top surface 38 of the girder 32, an elongated, hollow girder cap 64 is placed on top the deck sheeting 24 opposite the top surface 38 of the girder 32. A threaded fastener in the form of a bolt 66 is then driven through an aperture 68 in the girder cap 64 and into the grooved slot 40 within the top surface 38 of the girder 32. Because the grooved slot 40 extends along the entire length of the girder 32, threaded fasteners such as the bolt 66 can be driven therein at virtually any location along the length of the girder 32 without the need for drilling holes. As each bolt 66 is tightened onto the inside of the girder cap 64, the deck sheeting 24 is secured in place on the top surface 38 with the assistance of the grooved surface thereof and so as to extend over the ridges 60 and 62.

The deck sheeting 24 is installed on the frame or deck 22 in strips or coils which are wide enough to span the distance between adjacent pairs of the main girders 32 and which have a length extending across the entire floating roof 14. The deck sheeting 24 may be made of thin sheets of aluminum or other material which is light in weight and yet strong enough to form a lasting sealed cover over the frame or deck 22.

FIG. 8 illustrates the manner in which vapors from the liquid product in the tank 10 are prevented from escaping through the roof 16. Quantities of vapor 69 outside the girder 32 rise to the deck sheeting 24 where they are trapped. Quantities of vapor 69 at the inside of the girder 32 are trapped by the sealed nature of the upper portion of the girder 32. Because the bolt 66 resides within the slot 40, there is no opportunity for the sealed nature of the girder 32 to be penetrated by the means for fastening the deck sheeting 24 to the girder 24.

Figure 9:
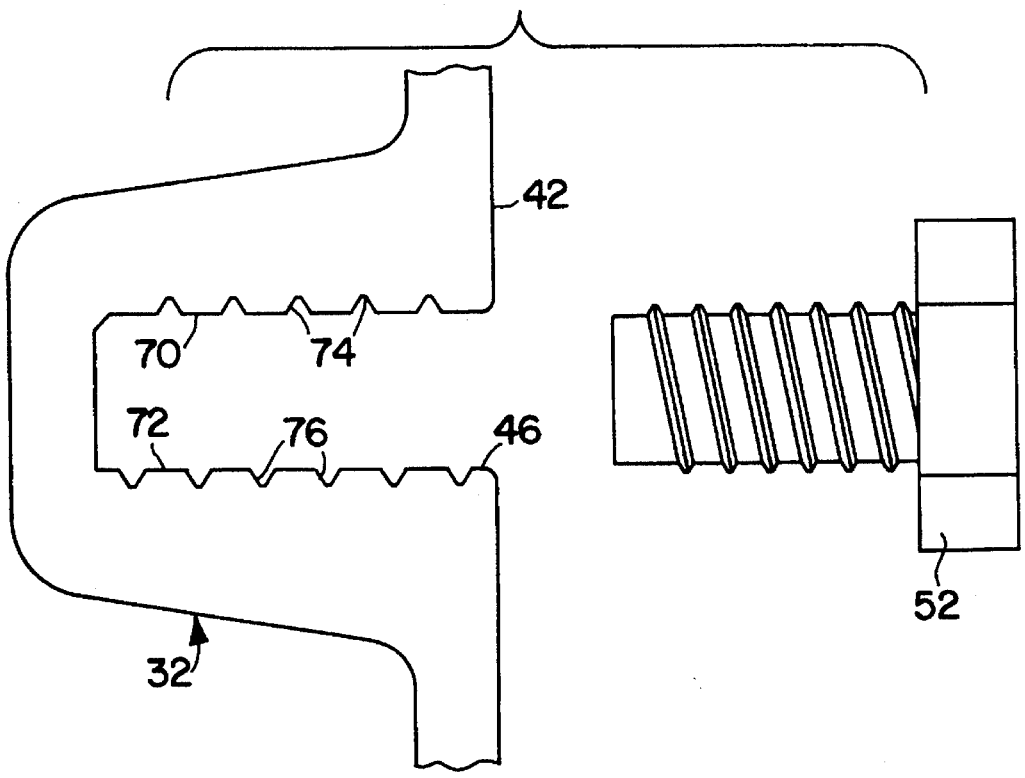
FIG. 9 is an enlarged view of one of the grooved slots of the girder of FIG. 5 together with a threaded fastener for securement therein.

FIG. 9 shows the grooved slot 46 in the side surface 42 of the girder 32 in detail. The grooved slots 40 and 48 are of like configuration. As shown in FIG. 9, the slot 46 has opposite surfaces 70 and 72. The surface 70 is provided with a series of spaced-apart, generally parallel grooves 74 which extend along the length of the girder 32. Similarly, the surface 72 is provided with grooves 76 extending along the length of the girder 32. The grooves 74 and 76 are formed in the surfaces 70 and 72 during extrusion of the girder 32. The grooves 76 are offset from the grooves 74 to provide a threaded effect. Therefore, the threads of the bolt 52 are received within the grooves 74 in the surface 70 and the grooves 76 within the surface 72, much in the same way as such threads would be received within a threaded aperture. The bolt 66 shown in FIG. 8 fits into the grooved slot 40 in the same way.

Figure 10:
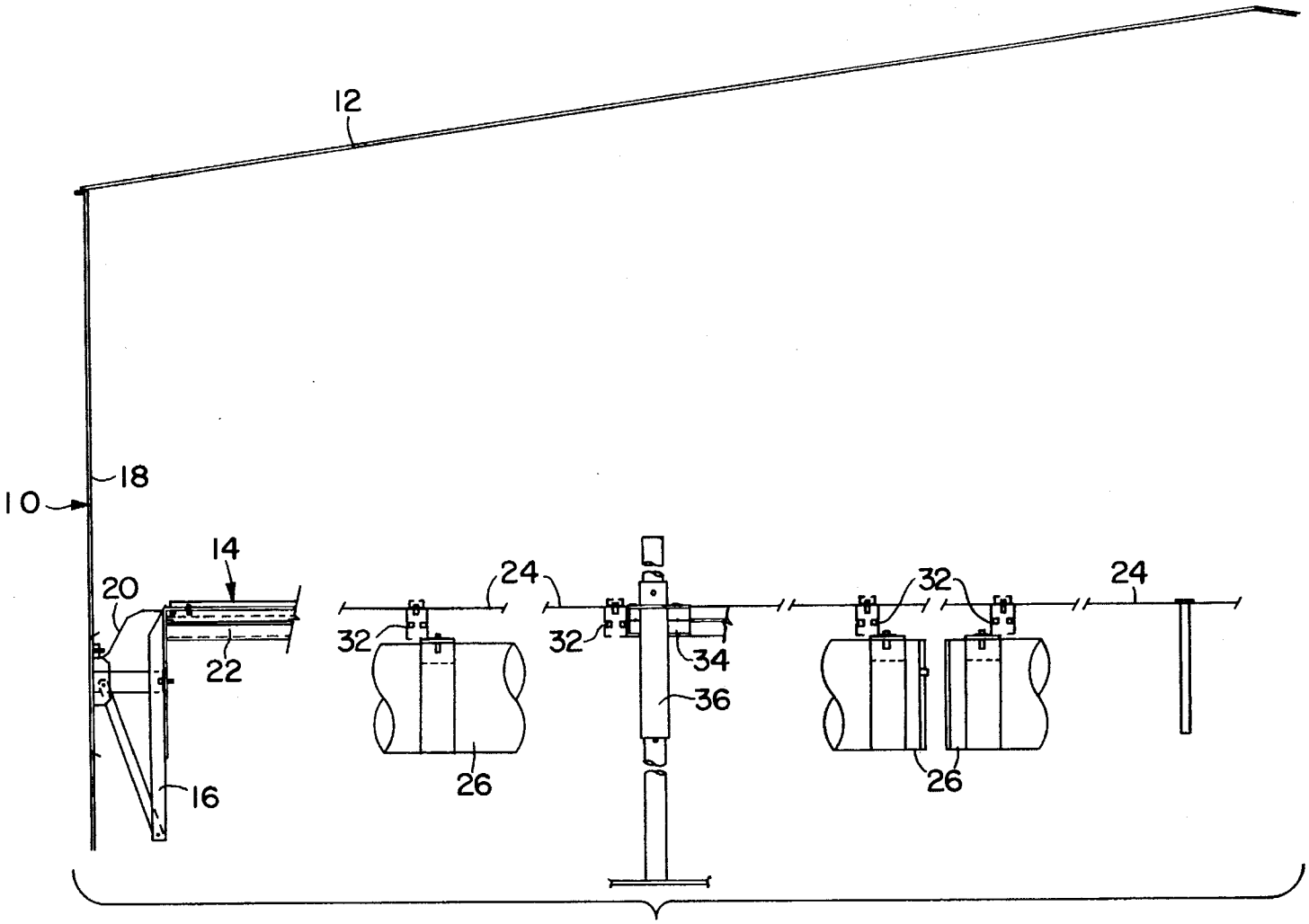
FIG. 10 is a side sectional view, broken apart, of a left side portion of the floating roof of the storage tank of FIG. 1, showing the manner in which a support leg and various pontoons are coupled to the girders of the roof frame.

The manner in which the pontoons 26 and the support leg assemblies 36 are maintained separate from each other and at the same time mounted on the frame or deck 22, in the case of floating roofs 14 in accordance with the invention, is illustrated in FIG. 10. As shown in FIG. 10, the tank 10 which has the overhead roof 12 thereabove includes the floating roof 14 having the outer rim 16, at which the floating roof 14 is sealed to the inner tank wall 18 by the seal 20. As described in detail hereafter, the pontoons 26 are coupled to the main girders 32, but not to each other, or to other members such as the support leg assembly 36. As shown in FIG. 10, even where the ends of adjacent pontoons 26 face each other, such ends remain unconnected. As previously described, the absence of any connection to the ends of the pontoons 26 greatly reduces the stresses to which such ends might otherwise be subjected. As also shown in FIG. 10, the support leg assemblies 36 are coupled to the girders of the frame 22, but not to the pontoons 26. As described in detail hereafter, each of the support leg assemblies 36 is coupled to the junction of one of the main girders 32 with one of the cross girders 34.

Figure 11:
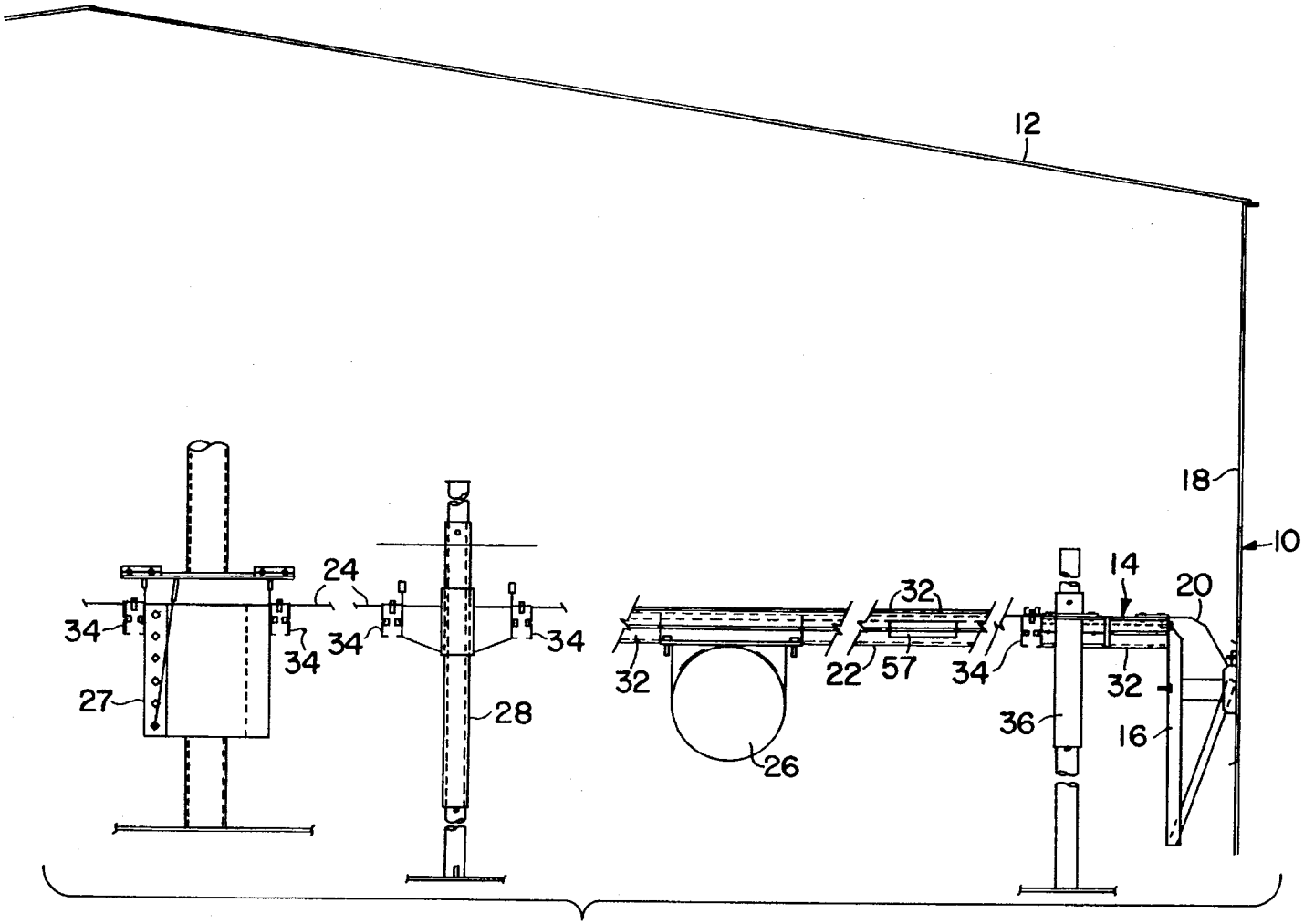
FIG. 11 is a side sectional view, broken apart, of a right side portion of the floating roof of the storage tank of FIG. 1, showing the manner in which a manway assembly, a bleeder vent assembly and a pontoon are coupled to the girders of the roof frame.

FIG. 11 shows a further portion of the storage tank 10 including part of the floating roof 14, and with the overhead roof 12 in place. As also shown in FIG. 11, the floating roof 14 terminates in the outer rim 16 at which the seal 20 is mounted for sealing the space between the outer rim 16 and the inner tank wall 18. An additional support leg assembly 36 is shown in FIG. 11 as being mounted at the junction of one of the main girders 32 with one of the cross girders 34. However, in FIG. 11, the direction of the girders 32 and 34 is reversed from what is shown in FIG. 10, so that the main girder 32 extends across the width of the plane of the drawing, whereas the cross girder 34 extends into the plane of the drawing. As also shown in FIG. 11, two of the main girders 32 are spliced together, end-to-end, in the manner shown and described in connection with FIG. 6. The splice plate 57 can be seen in FIG. 11.

The manway assembly 27 and one of the leader vent assemblies 28 is shown in FIG. 11. As described hereafter, the frame 22 comprised of the main girders 32 and the cross girders 34 serves to frame and support the manway assembly 27 and each of the bleeder vent assemblies 28. Opposite pairs of the girders 32 and 34 are used to frame and form the openings within the manway assembly 27 and the bleeder vent assembly 28. Again, and in accordance with the invention, members such as the manway assembly 27 and the bleeder vent assembly 28 are mounted on the frame 22 and are not coupled to other portions of the floating roof 14 for support.

Figure 12:
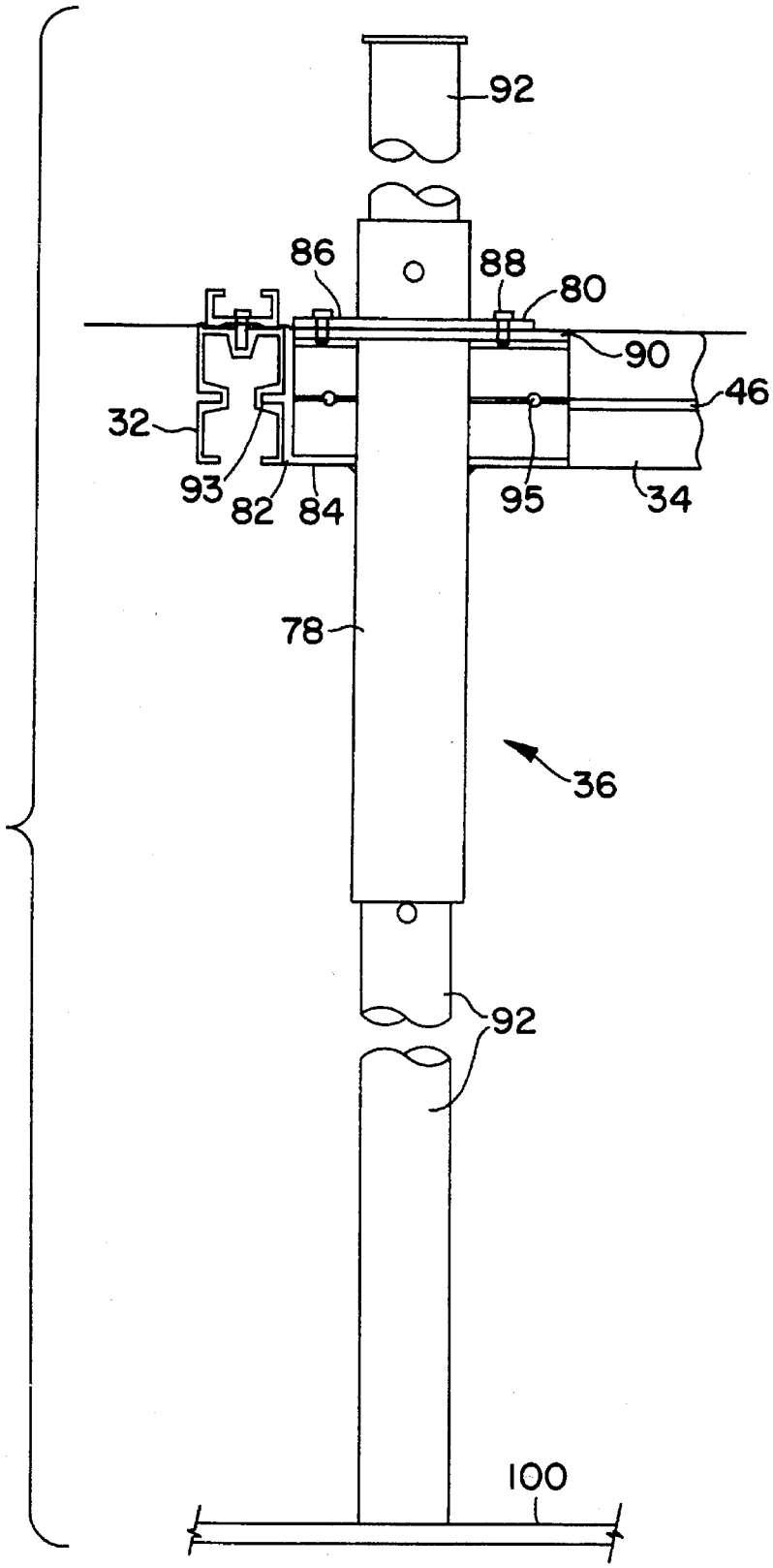
FIG. 12 is a side elevational view of the support leg assembly shown in FIG. 10.
Figure 13:
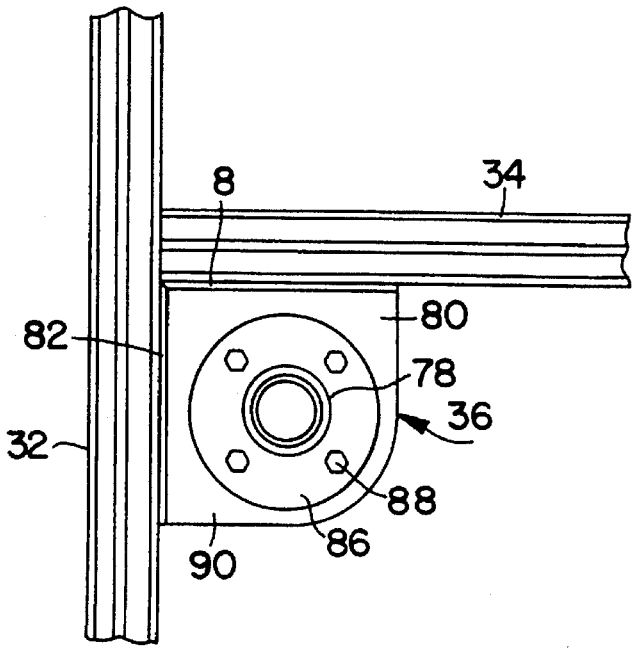
FIG. 13 is a top view of the support leg assembly of FIG. 12 showing the manner in which the leg assembly is coupled to the junction of a main girder and a cross girder.

In accordance with the invention, each support leg assembly 36 is coupled to the junction of two girders of the frame 22. As shown in FIGS. 12 and 13, a support leg assembly 36 is coupled to the junction of a main girder 32 and a cross girder 34. The support leg assembly 36 includes a support tube 92 forming the leg and adjustably positioned within a support housing top assembly 78 mounted within a support housing assembly 80. The support housing assembly 80 includes a mounting angle 82 which is configured like the mounting angle 50 of FIG. 5, except that it has a lower flange 84 thereof extending from the two 90° portions thereof into contact with the support housing top assembly 78. As in the case of the mounting angle 50 of FIG. 5, the mounting angle 82 has lateral flanges 93 which are inserted in the slots 46 in the girders 32 and 34 and bolts 95 which secure the mounting angle 82 in place. The support housing top assembly 78 has a circular flange 86 coupled thereto. The circular flange 86 is coupled by bolts 88 to an upper plate 90 forming a part of the support housing assembly 80. The upper plate 90, which is disposed above and spaced-apart from the lower flange 84, is mounted on the upper edge of the mounting angle 82, as by welding.

As shown in FIG. 12, the support leg assembly 36 includes the support tube 92 which is adjustably positioned within the support housing top assembly 78 and which forms the support leg. The support housing top assembly 78 extends through the upper plate 90 and through the lower flange 84. The support housing top assembly 78, which comprises a hollow tube, is coupled to the upper plate 90 by the circular flange 86 which is mounted thereon and which is bolted to the upper plate 90 by the bolts 88.

FIG. 13 is a top view of the support leg assembly 36 showing further details of the support housing assembly 80. As shown therein, the flange 86 resides on the upper plate 90 and is coupled thereto by the bolts 88. The upper plate 90 is joined to upper edges of the mounting angle 82, such as by welding. This forms an integral assembly which is easily coupled at the juncture of a main girder 32 with a cross girder 34 by simply driving the flanges 93 of the mounting angle 82 into the slots 46 in the side surfaces of the girders 32 and 34 and securing the mounting angle 82 in place with the bolts 95.

As shown in FIG. 12, the deck sheeting 24 is sandwiched between the circular flange 86 and the upper plate 90 of the support housing assembly 80 to discourage the escape of vapors from the liquid product through or around the support leg assembly 36. However, as described hereafter in connection with FIGS. 27–29, a gasket and a piston seal can be added to further prevent leakage of vapors through the support leg assembly 36.

Figure 14:
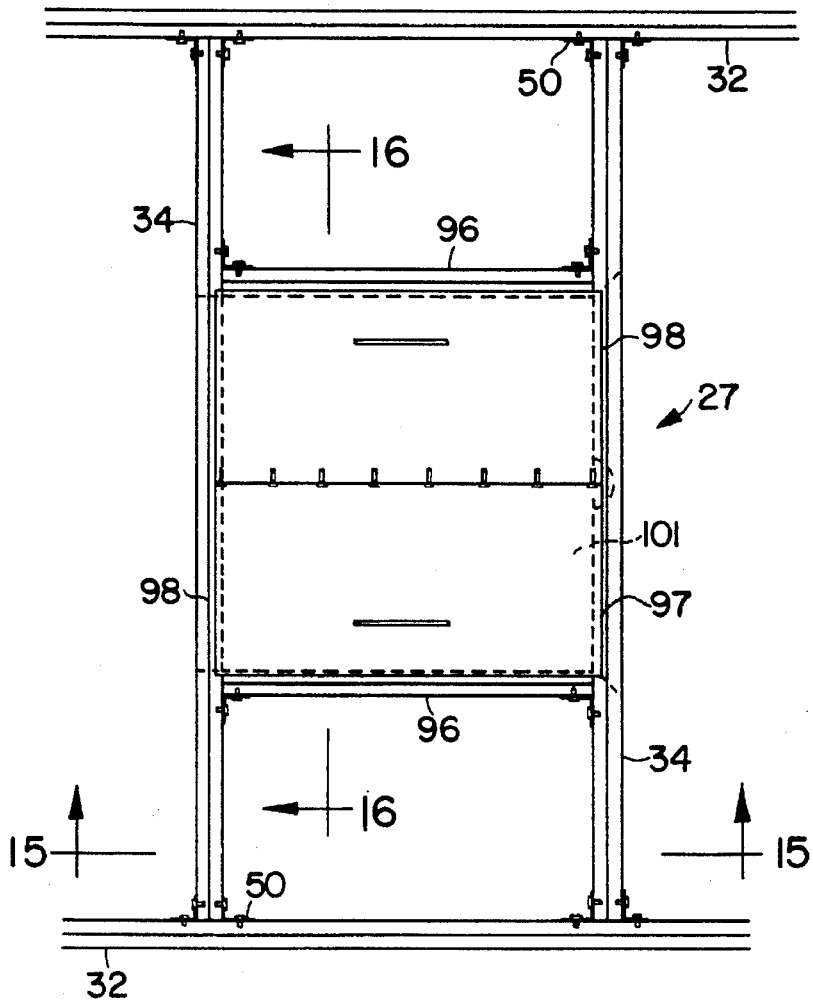
FIG. 14 is a top view of an arrangement of girders mounting the manway assembly of FIG. 11 to the frame of the floating roof.
Figure 15:
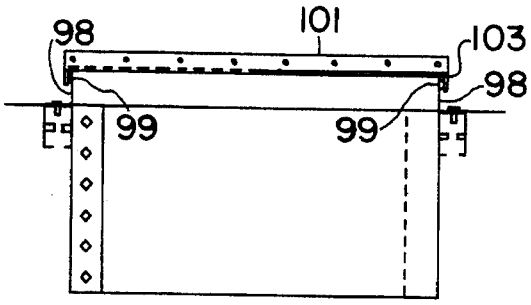
FIG. 15 is a sectional view of the arrangement of FIG. 14 taken along the line 15—15 thereof.
Figure 16:
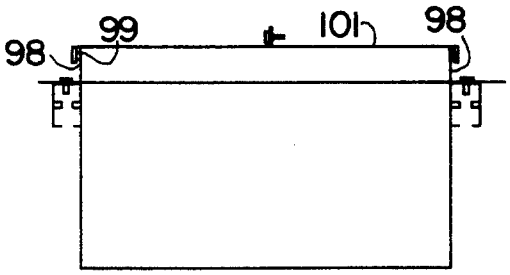
FIG. 16 is a sectional view of the arrangement of FIG. 14 taken along the line 16—16 thereof.

FIGS. 14–16 show the details of the manway assembly 27. As shown in FIG. 14, a pair of the cross girders 34 disposed in spaced-apart, generally parallel relation between opposite main girders 32 form a first pair of girders. The cross girders 34 are coupled to the main girders 32 using bolts and a plurality of the mounting angles 50, in the manner previously described. A further pair of girders 96 of relatively short length are coupled to intermediate portions of the cross girders 34 so as to form a second pair of spaced-apart, generally parallel girders. The girders 96 are spaced so as to form a generally square opening or manway 97 with the cross girders 34.

The manway assembly 27 includes four different support angles 98 of generally equal length mounted on the top surfaces of the cross girders 34 and the top surfaces of the girders 96 so as to form an upper extension of the manway opening 97. Each of the support angles 98 has an elastomer molding 99 mounted at the top edge thereof. The elastomer moldings 99 engage and form a sealing relationship with a generally square-shaped manway cover 101. The manway cover 101 has a flange 103 extending around the outer periphery thereof which extends over the elastomer molding 99 of the support angles 98, when the manway cover 101 is in place on top of the support angles 98.

The manway assembly 27 provides access to the underside of the floating roof 14, when such access is required such as for maintenance after the tank has been drained of its liquid product. Such access is provided by simply lifting the cover 101 from the opening formed by the support angles 98. It is then a simple matter to replace the cover 101 over such opening, at which time a sealing relationship is again formed between the cover 101 and the support angles 98 by the elastomer moldings 99 and by the flange 103 which abuts the exterior of the moldings 99. As will also be appreciated from FIG. 14, the manway assembly 27 is easily installed within the frame 22 of the floating roof 12 in accordance with the invention. Once the desired location of the manway assembly 27 is determined, it is a simple matter to mount the cross girders 34 on the main girders 32, and then mount the girders 96 to the cross girders 34. The cross girders 34 and the girders 96 are spaced-apart by generally equal distances, so as to frame the manway assembly 27 which is then mounted thereon.

When the liquid product is drained from the storage tank 10, the floating roof 14 resides at the bottom of the tank 10 where it is supported by the support leg assemblies 36. As shown in FIG. 12, the support tube 92 which forms one of the support legs rests on a tank bottom 100. The position of the support tube 92 within the support housing top assembly 78 is adjustable so as to vary the length of the leg during the process of levelling the floating roof 14 at the bottom of the storage tank 10, before the floating roof 14 is put into use.

Figure 17:
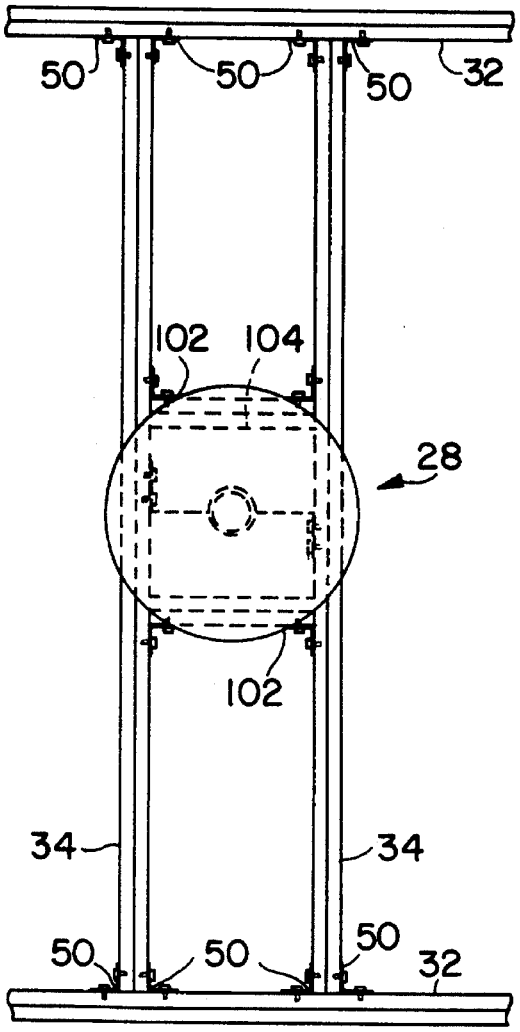
FIG. 17 is a top view of an arrangement of girders mounting the bleeder vent assembly of FIG. 11 to the frame of the floating roof.
Figure 18:
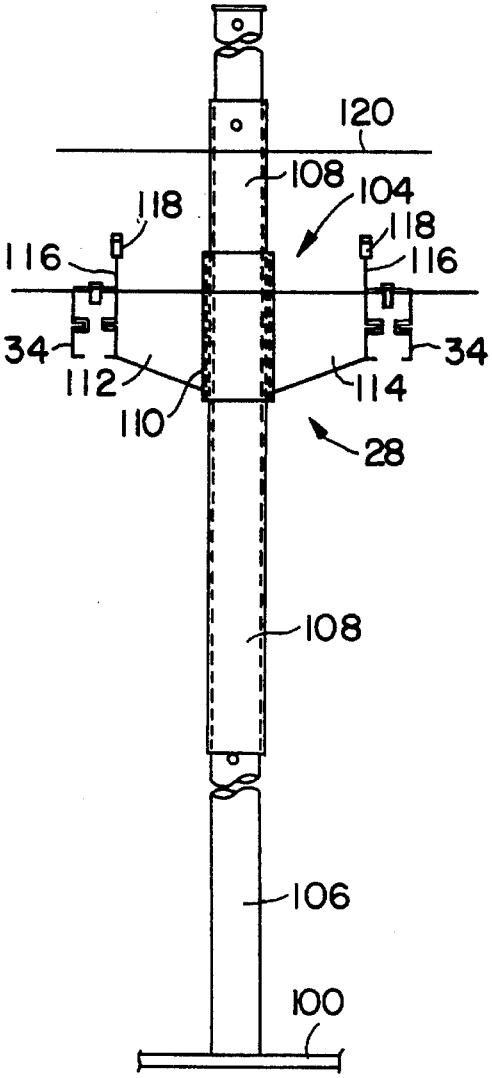
FIG. 18 is a side elevational view of the arrangement of FIG. 17.

One of the bleeder vent assemblies 28 of the floating roof 14 is shown in FIGS. 17 and 18. As in the case of the support leg assembly 36 of FIGS. 12 and 13, the bleeder vent assembly 28 is installed without the need for drilling holes. A pair of the cross girders 34 disposed in spaced-apart, generally parallel relation between opposite main girders 32 form a first pair of girders. The cross girders 34 are coupled to the main girders 32 using bolts and a plurality of the mounting angles 50, in the manner previously described. A further pair of girders 102 of relatively short length are coupled to intermediate portions of the cross girders 34 so as to form a second pair of spaced-apart, generally parallel girders. The girders 102 are spaced so as to form a generally square opening or bleeder well 104 with the cross girders 34.

As shown in FIG. 18, the bleeder vent assembly 28 includes a support tube 106 which forms a leg and which is slidably mounted within support tube sleeve assembly 108. The support tube sleeve assembly 108 is mounted within a bleeder guide assembly 110 which surrounds a portion of the support tube sleeve assembly 108 and which has opposite flanges 112 and 114 extending therefrom and into engagement with the cross girders 34. As shown in FIG. 17, each of the flanges 112 and 114 has a right-angle bend at the end thereof so that threaded bolts can be inserted therethrough and into the grooved slots in the side walls of the cross girders 34 to couple the flanges 112 and 114 thereto.

The bleeder vent assembly 28 includes four different well support angles 116 of generally equal length mounted on the top surfaces of the cross girders 34 and the top surfaces of the girders 102 so as to form an upper extension of the bleeder well 104. Each of the well support angles 116 has an elastomer molding 118 mounted on the top edge thereof. The elastomer moldings 118 engage and form a sealing relationship with a disk-shaped bleeder cover 120 coupled to the upper end of the support tube sleeve assembly 108.

The deck sheeting 24 terminates at the edges of the bleeder well 104 so that the well 104 is open to the bleeder cover 120 above. The well 104 is normally closed off by the bleeder cover 120 which resides on the tops of the elastomer moldings 118 at the upper edges of the well support angles 116. However, when the floating roof 14 is at the bottom of the storage tank 10, the support tube 106 engages the tank bottom 100, and this moves the support tube sleeve assembly 108 upwardly so as to raise the bleeder cover 120 above the well support angles 116. This allows the bleeder well 104 to vent the underside of the floating roof 114 to the atmosphere above the floating roof 14. This enables the bleeder vent assembly 28 to vent the floating roof 14. As previously noted, such venting is useful when filling the storage tank with liquid product or when draining liquid product from the storage tank 10. The venting action releases air and other gases which sometimes become trapped beneath the floating roof 14. The venting action also breaks or releases a vacuum which sometimes forms at the underside of the floating roof 14.

Figure 19:
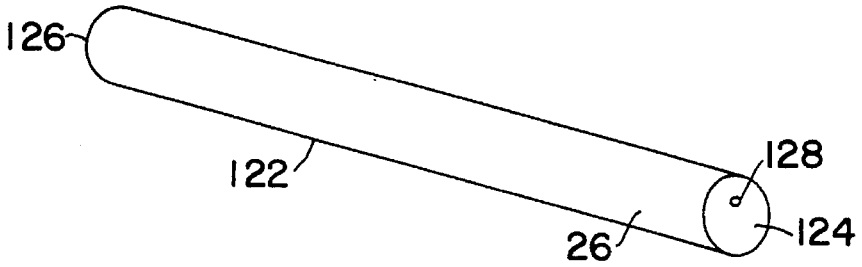
FIG. 19 is a perspective view of one of the pontoons of the floating roof of FIG. 2.

FIG. 19 shows one of the pontoons 26 of the floating roof 14. The pontoons 26 come in different lengths, as shown in FIG. 3, but otherwise are of like construction. The pontoon 26 is comprised of a hollow cylindrical tube 122 of aluminum or other appropriate material which is light in weight and yet relatively strong. The tube 122 has opposite open ends in which end caps 124 and 126 are mounted. The end cap 124 is provided with a vent plug 128 so that the sealing of the pontoon 26 can be tested. These features are described in greater detail hereafter in connection with FIGS. 25 and 26.

Figure 20:
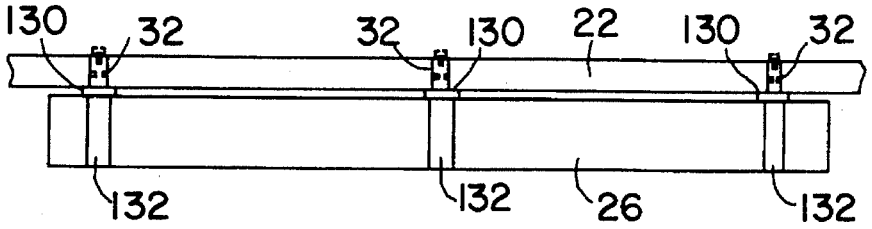
FIG. 20 is a side view of the pontoon of FIG. 19 showing the pontoon coupled to the girders of the floating roof.

FIG. 20 shows the pontoon 26 coupled at the underside of a plurality of the main girders 32. As noted above, the pontoons 26 of the floating roof 14 are provided in various different lengths. As shown in FIG. 3, the longest pontoon spans four of the main girders 32. The shortest pontoon spans two of the main girders 32. An intermediate size pontoon spans three of the main girders 32, and an example of one such pontoon is shown in FIG. 14. Each of the main girders 32 is coupled to the pontoon 26 by a saddle and strap assembly 130. As described in detail hereafter in connection with FIGS. 21 and 22, each saddle and strap assembly 130 includes a saddle for disposing the pontoon 26 against the underside of the main girder 32 and a strap 132 which encircles the pontoon 26.

Figure 21:
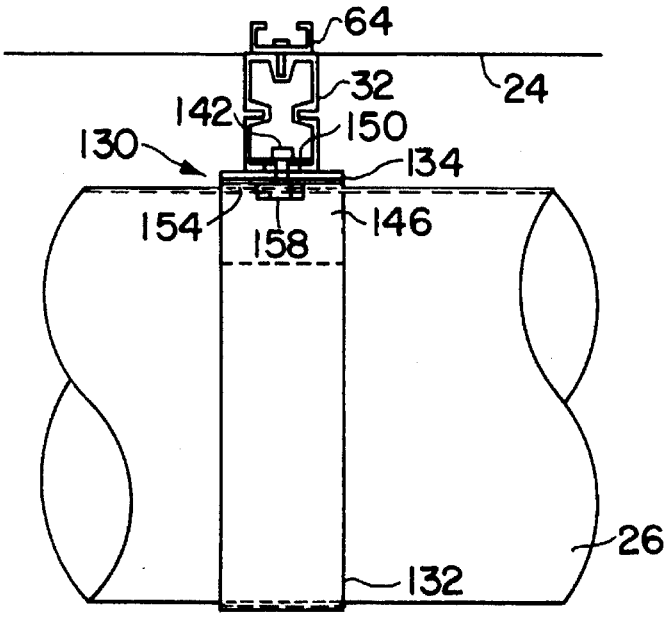
FIG. 21 is an enlarged view of a portion of the pontoon of FIG. 20, showing the details of a first arrangement for coupling the pontoon to one of the girders.
Figure 22:
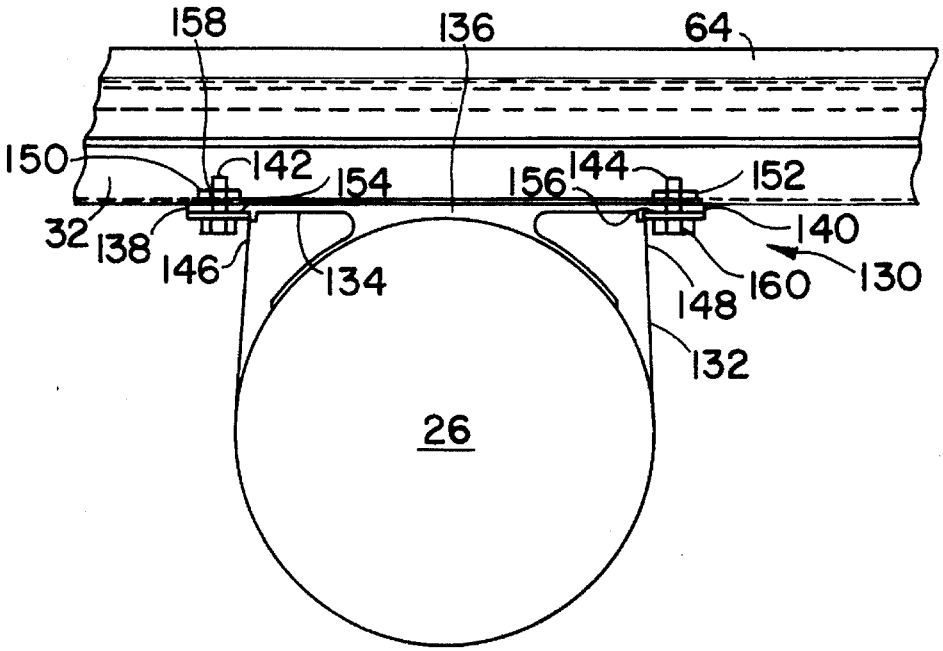
FIG. 22 is an end view of the arrangement of FIG. 21, showing the details of the saddle used in conjunction with the elongated metal strap to couple the pontoon to the girder.

The saddle and strap assembly 130 is shown in greater detail in FIGS. 21 and 22, in connection with a first arrangement for coupling the pontoon 26 to the girder 32. In addition to the strap 132, the assembly 130 includes an integrally formed, one-piece saddle 134 disposed against the underside of the main girder 32. The saddle 134 is of elongated configuration and has an intermediate portion 136 between opposite end portions 138 and 140. The intermediate portion 136 assumes the configuration of a circular arc so as to receive a portion of the pontoon 26 therein. The opposite end portions 138 and 140 define the locations of fasteners in the form of bolts 142 and 144 for fastening the saddle 134 and the strap 132 to the main girder 32. The one-piece construction of the saddle 134 fixes the locations of the bolts 142 and 144, thereby eliminating the need for a saddle strap at the lower portion of the main girder 32. The strap 132 which encircles the pontoon 26 has opposite ends 146 and 148 thereof which are coupled to the opposite end portions 138 and 140 of the saddle 134 by the bolts 142 and 144.

In the present example, the bolts 142 and 144 comprise studs which extend through bars 150 and 152, respectively, in a manner which prevents rotation of the bolts 142 and 144 relative to the bars 150 and 152. Each of the bars 150 and 152 is disposed within the main girder 32 so as to reside on the opposite legs 56 and 58 and span the slot 54 therebetween (shown in FIG. 7). The bars 150 and 152 are dimensioned to prevent rotation thereof within the main girder 32. The bolts 142 and 144 extend through apertures in the opposite end portions 138 and 140 of the saddle 134 and through apertures in the ends 146 and 148 of the strap 132. At the undersides of the ends 146 and 148 of the strap 132, the bolts 142 and 144 receive pinch washers 154 and 156, respectively, and nuts 158 and 160, respectively. In this manner, the bolts 142 and 144 secure the saddle 134 and the strap 132 to the bottom of the main girder 32.

The circular arc shape of the intermediate portion 136 of the saddle 134 functions to cradle the pontoon 26 in a manner which does not unduly stress the pontoon 26 in response to upward forces thereon. Mounting of the pontoons 26 in this fashion, combined with the fact that the support leg assemblies 36 are not coupled to the pontoons 26, results in a minimum of stresses and forces being applied to the pontoons 26.

Figure 23:
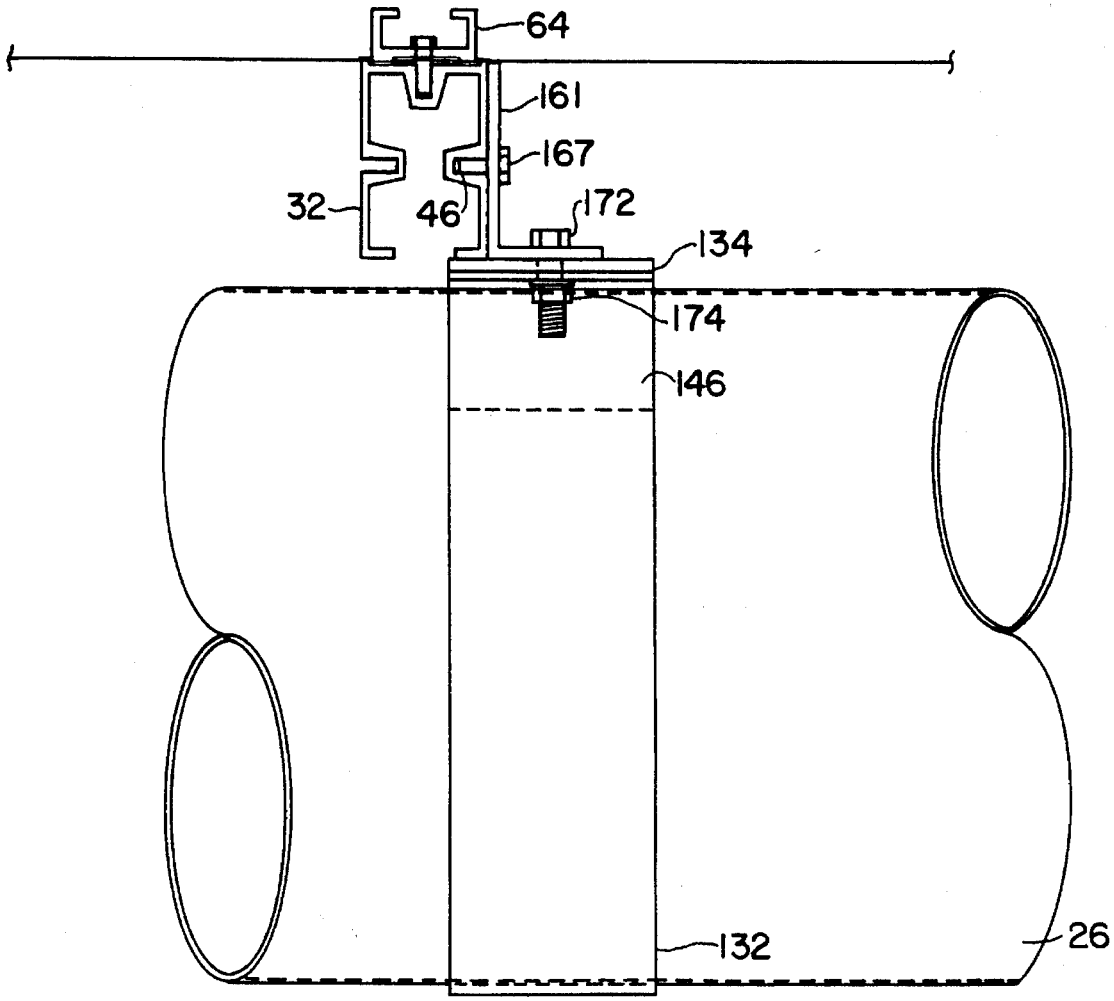
FIG. 23 is an enlarged view of a portion of the pontoon of FIG. 20, showing the details of a second arrangement for coupling the pontoon to one of the girders.

An alternative arrangement for coupling the pontoon 26 to the main girder 32 is shown in FIG. 23. The arrangement of FIG. 23 utilizes a mounting plate 161 which is shown in detail in FIG. 24. The mounting plate 161 is configured similarly to the extension plates 57 and 59 of FIG. 6, except for the presence of a flange 163 which extends outwardly at a lower edge of the mounting plate 161 opposite a lateral flange 165. The flange 165 is forced into the grooved slot 46 in the side of the main girder 32, and the mounting plate 161 is secured in place by a pair of bolts 167, one of which is shown in FIG. 23. The bolts 167 are driven through apertures 169 in the mounting plate 161, and into the grooved slot 46 in the main girder 32. The flange 163 at the lower edge of the mounting plate 161 is provided with a pair of apertures 170 therein. The apertures 170 enable a pair of bolts 172 to couple the saddle 134 to the underside of the flange 163. One of the bolts 172 is shown in FIG. 23. Each of the bolts 172 extends through one of the apertures 170 in the flange 163 and through one of the end portions 138 and 140 of the saddle 134 and one of the ends 146 and 148 of the strap 132, where it receives a nut 174.

Figure 25:
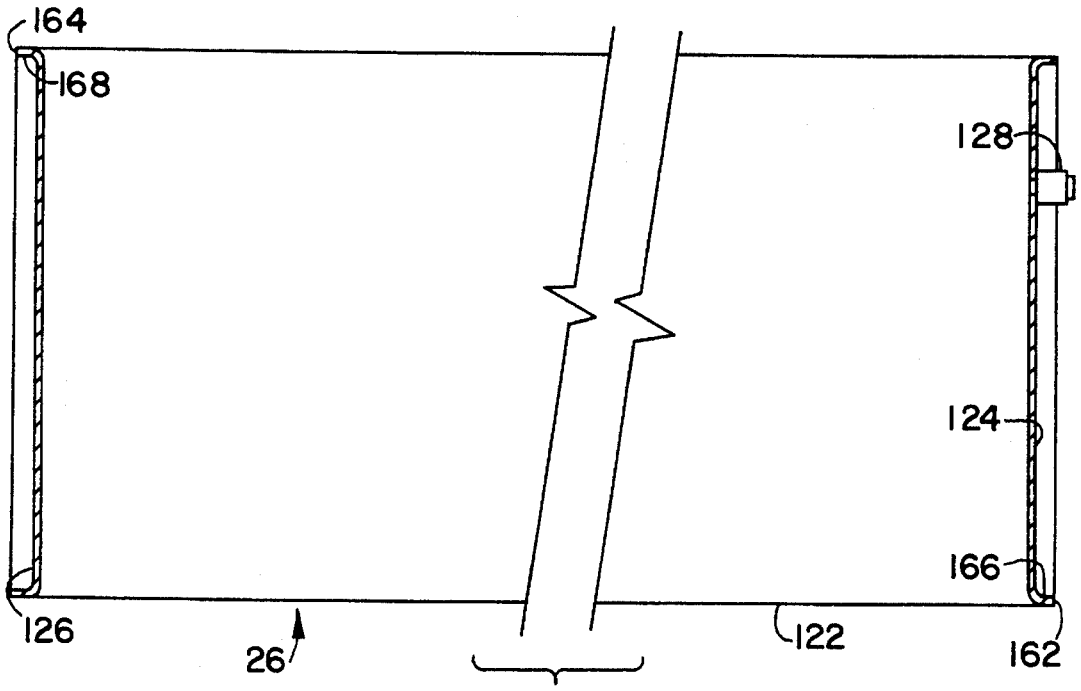
FIG. 25 is a sectional view of the pontoon of FIG. 19, showing the details of the end caps at the opposite ends of the pontoon.
Figure 26:
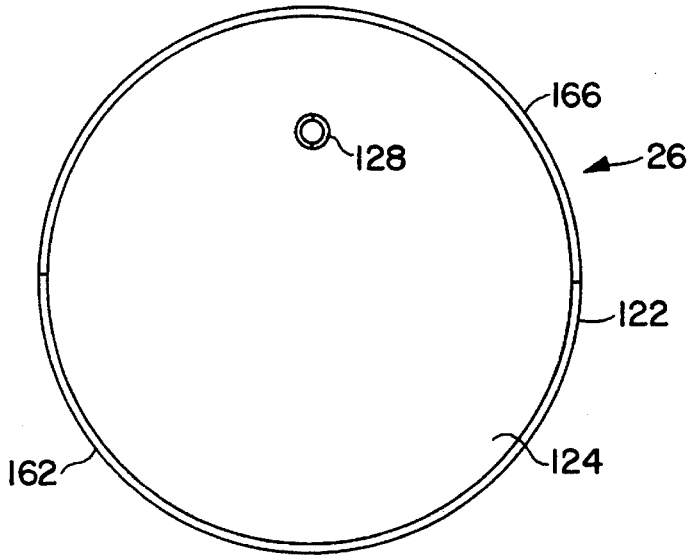
FIG. 26 is an end view of the pontoon of FIG. 19 showing the details of one of the end caps as installed therein.

The pontoon 26 is shown in greater detail in FIGS. 25 and 26. As previously noted in connection with FIG. 19, the pontoon 26 is comprised of the hollow cylindrical tube 122, the end cap 124 and the end cap 126. As shown in FIG. 25, each of the end caps 124 and 126 is recessed inwardly from opposite open ends 162 and 164 of the hollow cylindrical tube 122. The end cap 124, which is basically of relatively thin, generally planar construction, has an outer flange 166 disposed around the outer periphery of the end cap 124 so as to extend in a direction away from the plane of the end cap 124. The flange 166 resides against an inner surface of the hollow cylindrical tube 122 adjacent the open end 162 of the tube 122. In similar fashion, the end cap 126, which is of like configuration to the end cap 124, has a flange 168 extending outwardly from the plane of the end cap 126 and residing against the inner surface of the hollow cylindrical tube 122 at the open end 164 of the tube 122.

The disposition of the flanges 166 and 168 against the inner surface of the hollow cylindrical tube 122 adjacent the open ends 162 and 164 thereof facilitates welding of the flanges 166 and 168 to the open ends 162 and 164 along the entire circumference of each of the flanges 166 and 168, to provide a water-tight seal for the pontoon 26. In addition, disposition of the flanges 166 and 168 against the inner surface of the tube 122 serves to maintain the cylindrical shape of the tube 122, against external forces which tend to deform the tube 122. As previously noted, the vent plug 128 in the end cap 124 is used to gain access to the interior of the pontoon for purposes of testing the pontoon 26. In this manner, it can be determined if the pontoon 26 is air tight and watertight, following welding of the end caps 124 and 126 in place.

In the support leg assembly 36 previously described in connection with FIGS. 12 and 13, the deck sheeting 24 which surrounds the support housing assembly 80 extends into the interface between the circular flange 86 and the upper plate 90, as well as being clamped to the top surfaces of the main girder 32 and the cross girder 34. This acts to minimize the escape of vapors from the liquid product through and around the support leg assemblies 36 of the floating roof. However, in view of the increasingly more stringent limitation of emissions from floating roofs, additional sealing against the unwanted escape of vapors may be necessary or desirable for many applications.

Figure 27:
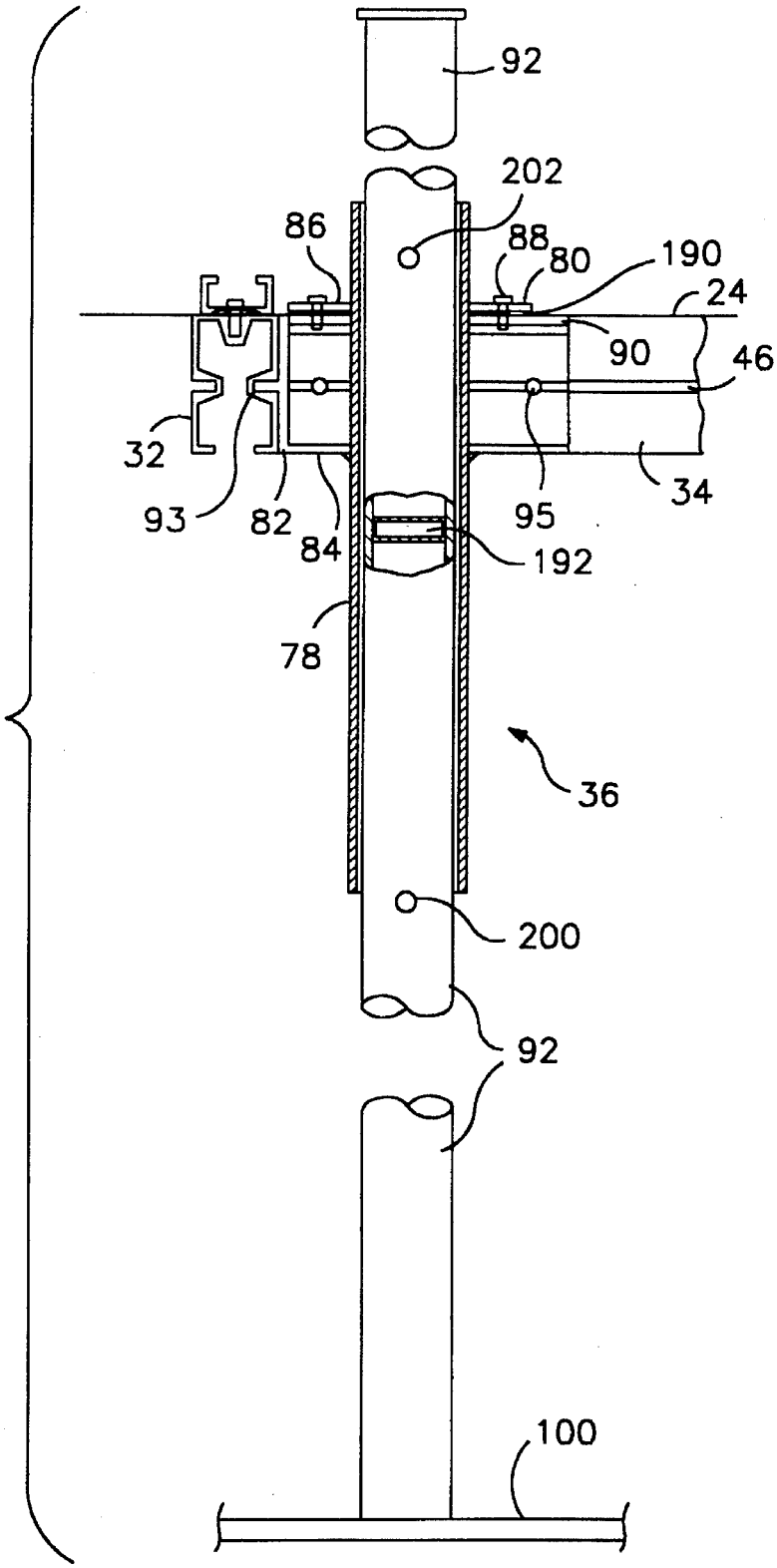
FIG. 27 is a side elevational view of a support leg assembly similar to that shown in FIG. 12 but with the support housing top assembly shown in section in order to illustrate a sealing gasket and a vapor seal in accordance with a further embodiment of the support leg assembly.

Such additional sealing is provided by the modified arrangement of the support leg assembly 36 shown in FIG. 27. The arrangement of FIG. 27 is like that of FIG. 12, with two exceptions. One exception relates to the addition of a sealing gasket 190 between the circular flange 86 and the upper plate 90 of the support housing assembly 80. This is shown in detail in FIG. 28. The other exception relates to the addition of a cup-shaped piston seal 192 to the hollow interior of the support tube 92 at an upper region thereof. The piston seal 192 is shown in detail in FIG. 29.

Figure 28:
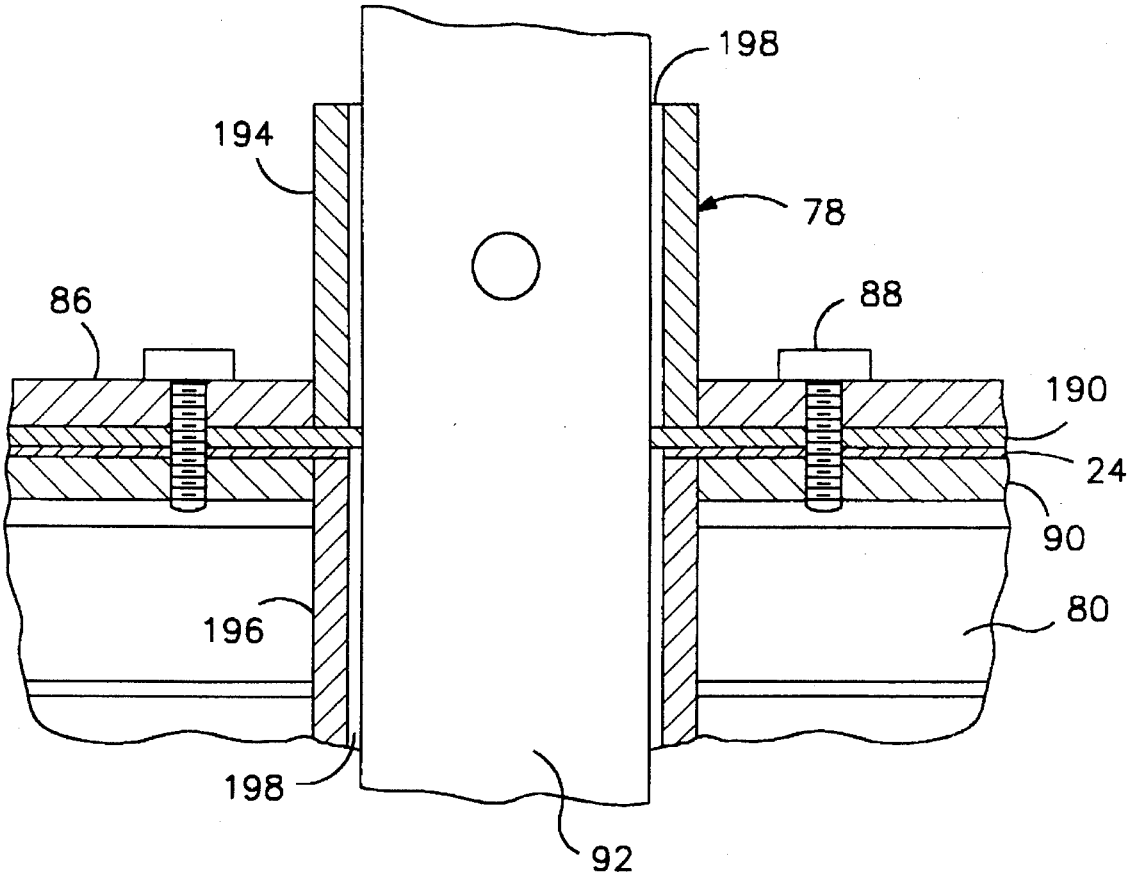
FIG. 28 is an enlarged view of a portion of the support leg assembly of FIG. 27 showing the manner in which the sealing gasket seals the space between the support housing top assembly and the support tube.

Referring to FIG. 28, it will be seen that the upper portion of the support housing top assembly 78 consists of axially separated upper and lower portions 194 and 196 thereof which have inner surfaces surrounding the outer surface of the support tube 92 so as to form a relatively small annular space 198 therebetween. With a lower portion of the support leg assembly 36 submerged in the liquid product, such product and vapors therefrom may enter the annular space 198 at the lower end of the support housing top assembly 78 and travel upwardly therethrough. To prevent the vapors from traveling upwardly along the inside of the upper portion 194 of the support housing top assembly 78 and escaping into the atmosphere, the sealing gasket 190 is provided. The sealing gasket 190 extends through the annular space between the upper and lower portions 194 and 196 of the support housing top assembly 78 and into contact with the outer surface of the support tube 92. Tightening the bolts 88 serves to further press the sealing gasket 190 against the outer surface of the support tube 92 so as to maintain the seal therewith. At the same time, the gasket 190, which is made of appropriate elastomeric material, allows the support tube 92 to slide up and down within the support housing top assembly 78. Vapors traveling up the annular space 198 between the support tube 92 and the lower portion 196 of the support housing top assembly 78 are blocked by the sealing gasket 190. The sealing gasket 190 is of disk-shaped configuration and with a central aperture for receiving the support tube 92 therein, so as to completely surround the support tube 92.

The support tube 92 is provided with a plurality of apertures therein for adjusting the length of the support leg assembly 36 when the floating roof 14 is resting on the tank bottom 100. As shown in FIG. 27, at least one such aperture 200 is located in a lower portion of the support tube 92 where the liquid product or vapors therefrom can enter a hollow interior of the support tube 92 through the aperture 200. While the upper end of the support tube 92 is capped, it also contains one or more apertures such as the aperture 202 shown in FIG. 27. Consequently, vapors entering the hollow interior of the support tube 92 and traveling upwardly therethrough could exit an upper aperture such as the aperture 202 so as to escape into the atmosphere above. To prevent this from happening, the cup-shaped piston seal 192 is positioned within the hollow interior of the support tube 92 between the apertures 200 and 202, as shown in FIG. 27. The piston seal 192 extends across the entire cross-sectional area of the interior of the support tube 92 to prevent vapors from passing.

Figure 29:
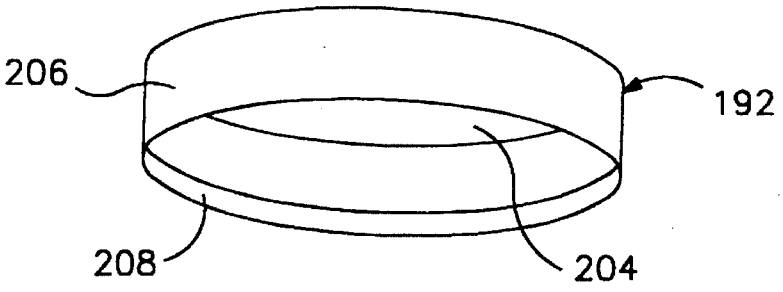
FIG. 29 is a perspective view of the vapor seal of FIG. 27.

The cup-shaped piston seal 192 is shown in detail in FIG. 29. As shown therein, the piston seal 192 has a disk-shaped top portion 204 which terminates at an outer circumference thereof in a downwardly extending, generally ring-shaped outer wall portion 206. The outer wall portion 206 terminates in a beveled lower edge 208 thereof.

The piston seal 192 is made of an appropriate elastomeric material. The elastomeric nature of the material combines with the shape of the piston seal 192 to maintain the outer wall portion 206 tightly seated against the interior wall of the support tube 92. As vapor pressure increases at the underside of the piston seal 192, the piston seal 192 is pressed more firmly against the inner wall of the support tube 92 to maintain the necessary sealing action therewith.

Frequently, it is necessary or desirable to provide a floating roof such as the roof 14 with one or more liquid drains. Such drains allow rain water and other liquids which may accumulate on the upper surface of the floating roof, such as on the deck sheeting 24 of the floating roof 14, to drain to the underside of the floating roof. At the same time, however, such liquid drains should not permit vapors from the liquid product to escape to the atmosphere above the floating roof. This requires the liquid drains to seal against the escape of vapors, except when liquid is being drained therethrough.

Figure 30:
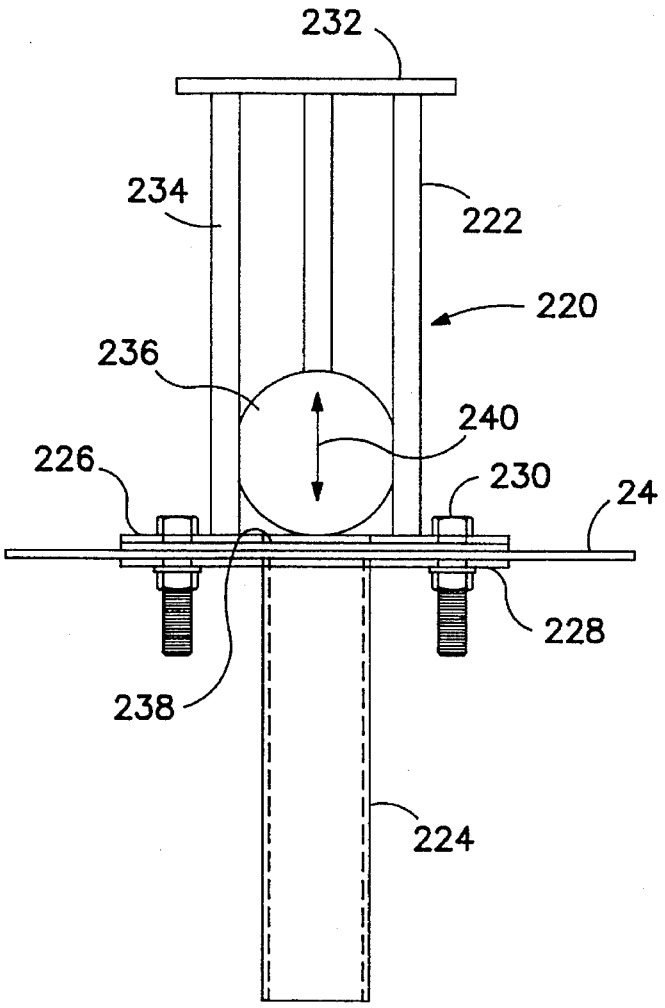
FIG. 30 is a front elevational view of a deck drain in accordance with the invention.
Figure 31:
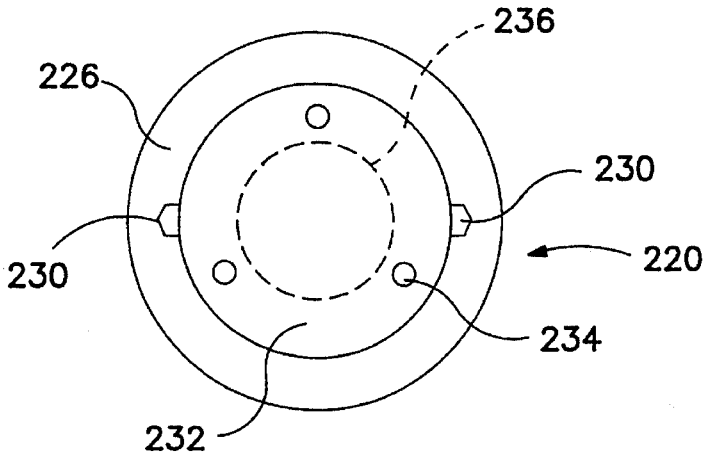
FIG. 31 is a top view of the deck drain of FIG. 20.

Such a deck drain 220 in accordance with the present invention is shown in FIGS. 30 and 31. As shown in FIG. 30, the deck drain 220 is mounted on the deck sheeting 24, and includes a check valve 222 disposed above the deck sheeting 24 and a hollow drain tube 224 extending downwardly at the underside of the deck sheeting 24. The check valve 222 is mounted on a circular plate 226 disposed on the upper surface of the deck sheeting 24. An opposite circular plate 228, disposed against the underside of the deck sheeting 24, has an upper portion of the hollow drain tube 224 secured within a central portion thereof. The circular plates 226 and 228 are held together, and the deck sheeting 24 is sandwiched therebetween, by bolts 230 extending through the circular plates 226 and 228 and the deck sheeting 24.

The check valve 222 is comprised of a circular upper plate 232 disposed above the circular plate 226, and three rods 234 extending in parallel, spaced-apart relation between the circular upper plate 232 and the circular plate 226. The three rods 234 define a cage for an elastomeric ball 236 slidably disposed at the inside of the rods 234. The ball 236 seats within and seals an upper open end 238 of the hollow drain tube 224 when in its lowermost position within the cage defined by the rods 234. The force of gravity maintains the ball 236 in this lowermost sealing position, except when the ball 236 is raised from this position, due to its buoyant nature when submerged in liquid on the deck sheeting 24. The ball 236 is capable of sliding upwardly and downwardly within the cage defined by the rods 234, as represented by an arrow 240 in FIG. 30.

When rainwater or other liquid accumulates on the deck sheeting 24, the ball 236 resides within such liquid. As the level of the liquid rises, the buoyant nature of the resilient material comprising the ball 236 causes the ball 236 to float upwardly within the cage defined by the rods 234. As the ball 236 rises within the rods 234, the upper open end 238 of the hollow drain tube 224 is uncovered and exposed, allowing the liquid to drain through the tube 224. As the liquid drains through the tube 224, the ball 236 is lowered until it eventually seats within the upper open end 238 as the liquid is completely discharged through the tube 224. The ball 236 remains in this lowermost sealing position to prevent vapors from the liquid product from rising upwardly through the tube 224 and escaping, until liquid once again accumulates on the deck sheeting 24 so as to raise the ball 236 at the inside of the rods 234.

FIG. 3 shows and describes the various pontoons 26 of the floating roof 14 as being mounted on the main girders 32 and the cross girders 34. However, it is desirable for many applications to mount a few pontoons on the curved outer rim of the floating roof, in order to support the outer rim. Thus, in the case of the floating roof 14 of FIG. 3, it may be desirable to utilize several of the pontoons 26 to support the channel 30 which forms the curved outer rim of the roof. To do this, the supporting pontoons 26 must be mounted on the channel 30 at the underside thereof.

In prior art floating roofs, pontoons are sometimes mounted on and adjacent the curved outer rim as well as on the inner portions of the frame 22. This is desirable for some applications such as where a roof seal mounted at the outer rim of the roof requires additional floating support at or close to the outer rim. Such installations often require that gussets be welded to the pontoons. However, having to weld the gussets to the pontoons is a step which should desirably be avoided. Additionally, it would be desirable to provide an improved arrangement for mounting the pontoons on the outer rim.

Figures 32, 33, 34:
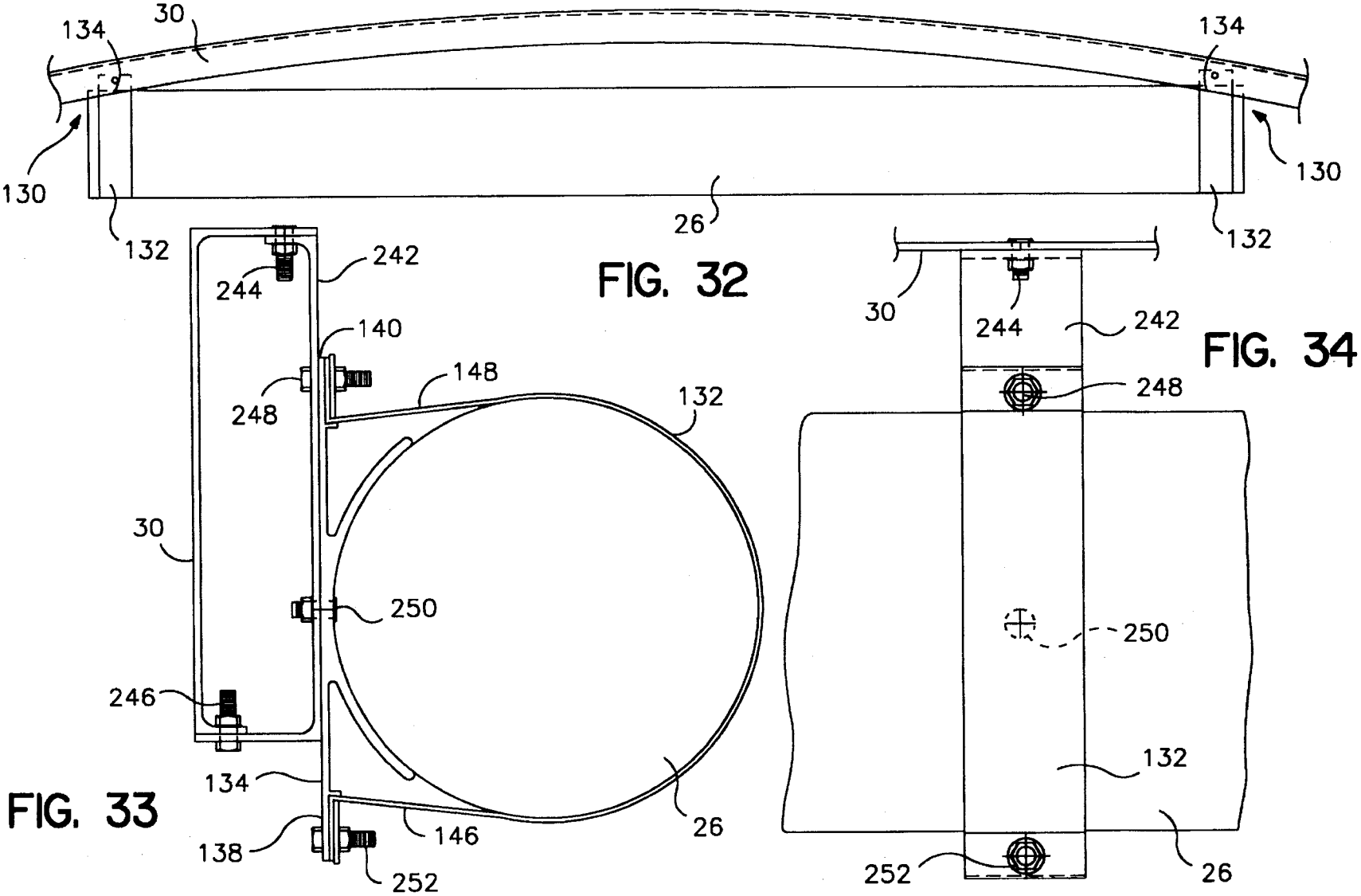
FIG. 32 is a top view of a portion of the rim of a floating roof, such as the floating roof shown in FIG. 2, and illustrating an arrangement for mounting a pontoon on the rim.
FIG. 33 is a side view of the arrangement of FIG. 32.
FIG. 34 is a front view of the arrangement of FIG. 32.

In accordance with the invention, and as shown in FIGS. 32–34, an arrangement is provided whereby pontoons are easily attached to virtually any desired location along the curved outer rim of the floating roof, without the need for undesirable welding. The opposite ends of each pontoon are secured with saddle and strap arrangements, much like those previously described in connection with FIGS. 21 and 22. However, the saddle and strap arrangements are attached to rim mounting brackets which are attached to inner portions of the curved outer rim of the floating roof. The mounting brackets are capable of being positioned at different angular orientations and at different locations along the length of the curved outer rim of the floating roof, so that pontoons of virtually any desired length can be easily mounted at virtually any location along the curved outer rim of the roof without the need for welding.

Referring to FIG. 32, a pontoon 26 shown therein has the opposite ends thereof coupled to a portion of the channel 30 by saddle and strap assemblies 132 which are like those shown and described in FIGS. 21 and 22. Each of the saddle and strap assemblies 130 includes a strap 132 encircling a portion of one of the ends of the pontoon 26 and having the opposite ends thereof coupled, such as by bolting, to a saddle 134. This is shown in detail in FIGS. 33 and 34. As shown therein, the strap 132 has opposite ends 146 and 148 secured to the opposite end portions 138 and 140, respectively, of the saddle 134.

As further shown in FIGS. 33 and 34, the saddles 134 at the opposite ends of the pontoon 26 are coupled to the channel 30 by rim mounting brackets 242. As shown in FIG. 33, each rim mounting bracket 242 has a cross-sectional shape like that of the channel 30, but inverted. For this reason, the rim mounting brackets 242 can be cut and formed from the same channel stock used to form the channel 30 around the outer rim of the floating roof 14. The opposite upper and lower ends of the rim mounting bracket 242 are attached to flanges formed at the upper and lower ends of the channel 30 by bolts 244 and 246. Because of these attachments, and because each bracket 242 is relatively narrow as shown in FIG. 34, the brackets 242 can be positioned at various desired orientations relative to the channel 30. A bolt 248, which is used to couple the end 148 of the strap 132 to the end portion 140 of the saddle 134, is also used to couple the saddle 134 to the rim mounting bracket 242. A second bolt 250 extends through a central portion of the saddle 134 and into the rim mounting bracket 242, to assist in securing the saddle 134 to the rim mounting bracket 242. A third bolt 252 secures the end 146 of the strap 132 to the end portion 138 of the saddle 134.

As previously described in connection with FIGS. 23 and 24, the pontoon 26 can be mounted on a girder such as one of the main girders 32, using a mounting plate 161 having an opposite lateral flange 165 for disposition within the grooved slot 46 in the side of the main girder 32. After securing the mounting plate 161 in place on the main girder 32, using bolts 167, the saddle 134 and included strap 132 are then secured to opposite ends of the flange 163 extending outwardly from the mounting plate 161. Each end of the strap 132 is secured by a bolt extending through an adjacent end of the saddle 134 to an adjacent one of the opposite ends of the flange 163.

Figure 24:
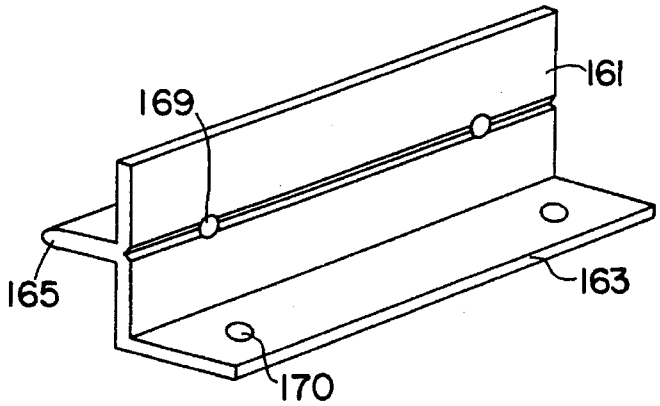
FIG. 24 is a perspective view of a mounting plate used in the arrangement of FIG. 23.

While the pontoon mounting arrangement shown and described in connection with FIGS. 23 and 24 provides an advantageous way of mounting the pontoon to the girder, it may be desirable to provide a pontoon mounting arrangement which is similar and yet which allows the pontoon to be disposed at virtually any orientation relative to the main girder 32 or other structural member to which the pontoon is being mounted. This is particularly useful in instances where it is desired to mount pontoons adjacent the outer perimeter of the floating roof. Such an arrangement is shown in FIGS. 35–37.

Figure 35:
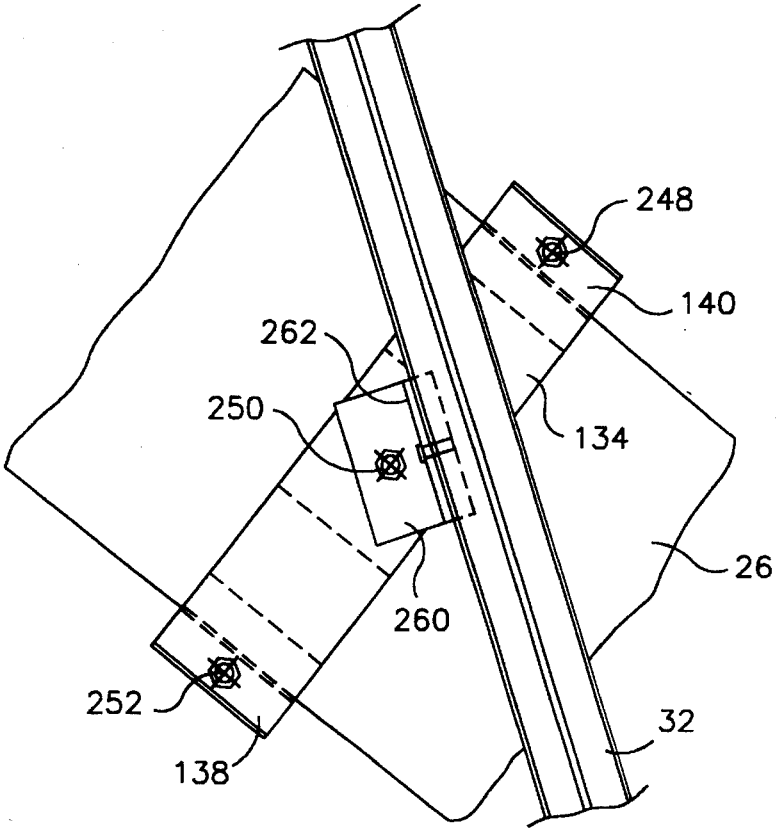
FIG. 35 is a top view of a third arrangement for coupling the pontoon of FIG. 20 to one of the girders.
Figure 36:
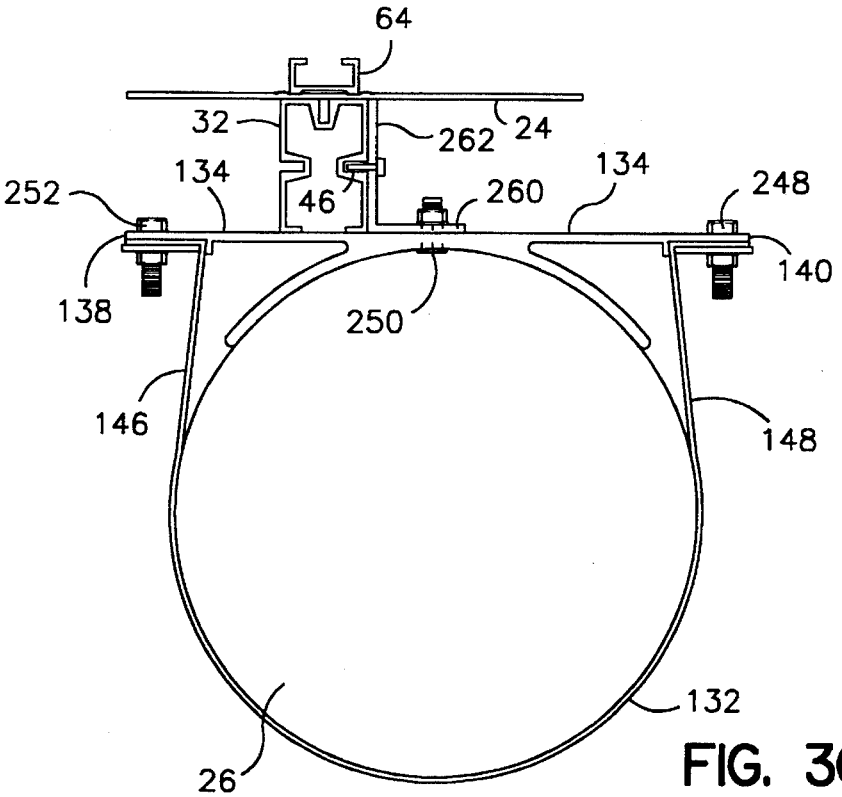
FIG. 36 is an end view of the arrangement of FIG. 35.
Figure 37:
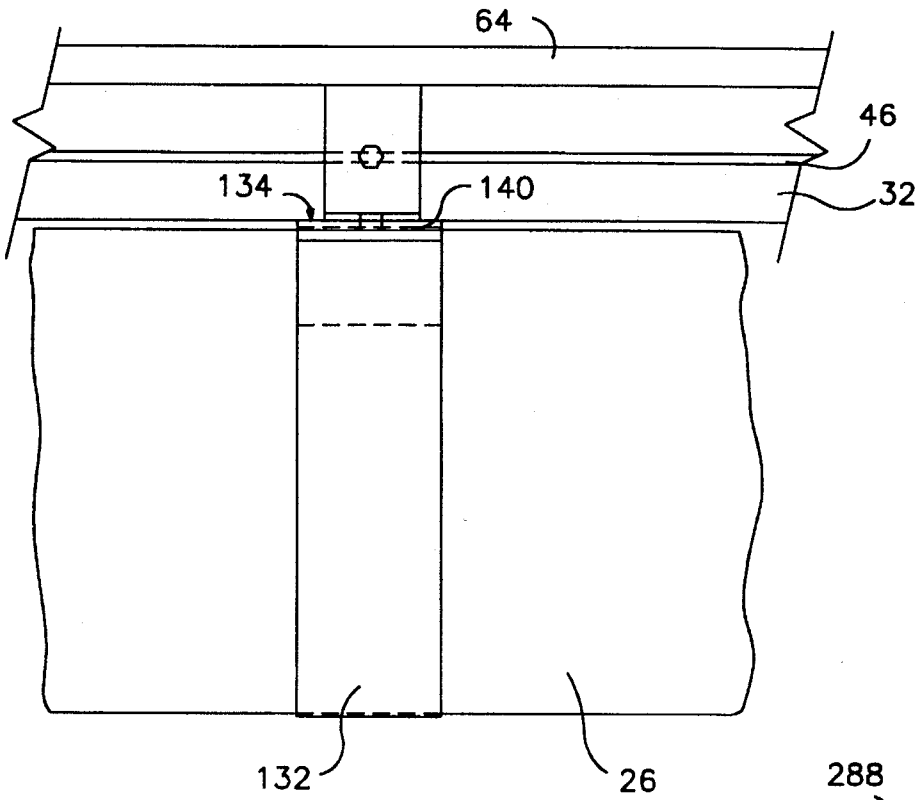
FIG. 37 is a front view of the arrangement of FIG. 35.

As shown in FIGS. 35–37, the mounting arrangement thereof utilizes the same strap 132 and saddle 134 as in the arrangements of FIGS. 21 and 22, FIGS. 23 and 24, and FIGS. 32–34. As in the arrangement of FIGS. 32–34, the end 146 of the strap 132 is coupled to the end portion 138 of the saddle 134 by the bolt 252. In similar fashion, the end 148 of the strap 132 is coupled to the end portion 140 of the saddle 134 by the bolt 248. In the previously described arrangement of FIGS. 32–34, a bolt 250 extends through a central portion of the saddle 134 to couple the saddle 134 to the rim mounting bracket 242. However, in the arrangement of FIGS. 35–37, the bolt 250 extends through the central portion of the saddle 134 to couple the saddle to a flange 260 extending from a lower end of a mounting plate 262.

The mounting plate 262 in the arrangement of FIGS. 35–37 is similar to but considerably shorter than the mounting plate 161 of the arrangement of FIGS. 23 and 24. Moreover, instead of using two spaced apart bolts or other fasteners to couple the saddle 134 to the mounting plate, as in the case of FIGS. 23 and 24, the arrangement of FIGS. 35–37 uses the single bolt 250 to couple the central portion of the saddle 134 to the flange 260 of the mounting plate 262. This allows the pontoon 26 to assume a virtually unlimited range of different angular positions relative to the main girder 32.

For various floating roof configurations, it may be desirable to be able to mount the pontoons other than parallel to or at right angles relative to the various girders. In particular, it may be desired to mount some of the pontoons which are adjacent to the curved outer rim of the floating roof so that such pontoons extend generally longitudinally adjacent to a portion of the outer rim. To mount the pontoons in this manner, the arrangement shown in FIGS. 35–37 may be used. Such arrangement permits each end of the pontoon to be oriented at virtually any angle relative to a structural member such as the main girder 32 to which the pontoon is being mounted.

As in the case of the mounting arrangement of FIGS. 23 and 24, the mounting plate 262 of FIGS. 35–37 has a lateral flange 264 on the back thereof and opposite the flange 260 for disposition within the grooved slot 46 in the main girder 32. The mounting plate 262 is secured in a desired position along the length of the main girder 32 by a bolt 266 extending through the mounting plate 262 and into the grooved slot 46 in the main girder 32.

Figure 38:
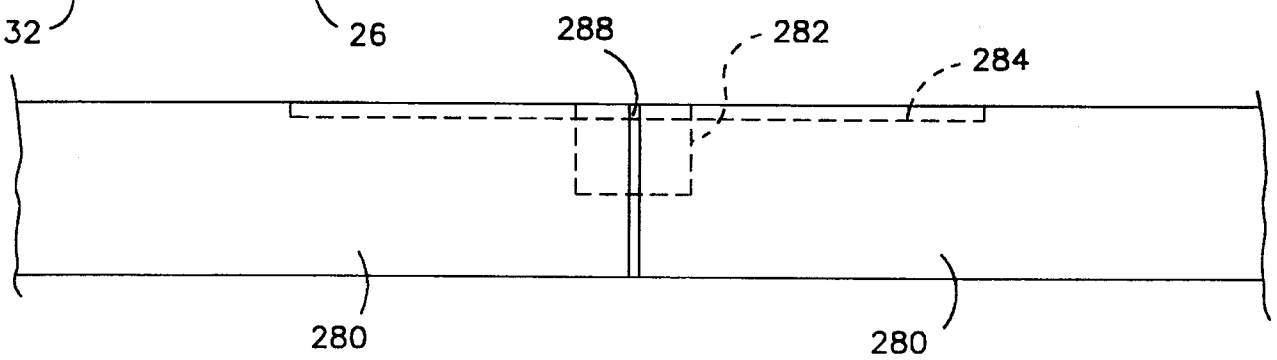
FIG. 38 is a top view of a portion of the rim of a floating roof, such as the floating roof shown in FIG. 2, and illustrating a splicing arrangement for the rim.
Figure 39:
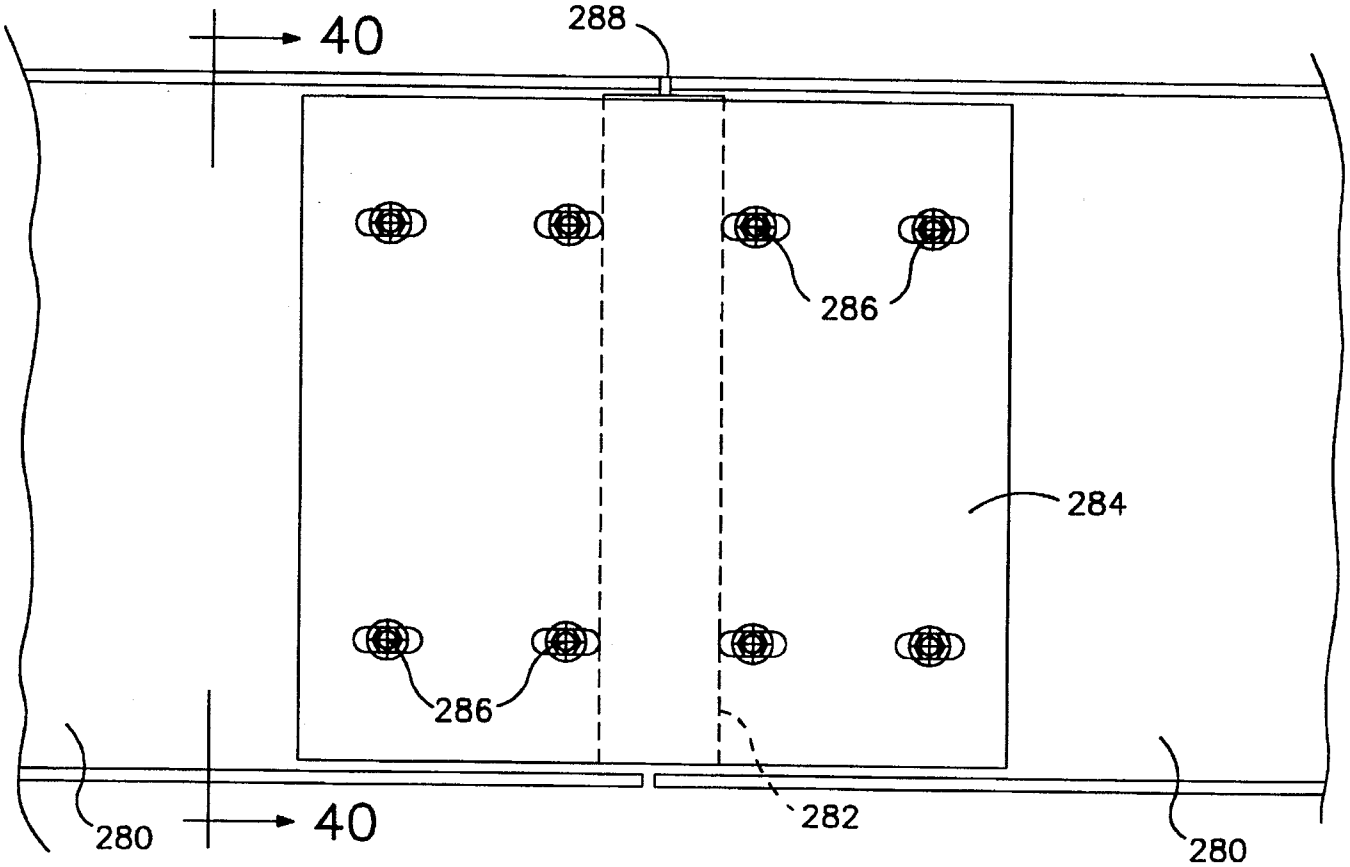
FIG. 39 is a front view of the arrangement of FIG. 38.

The channel 30 which forms the circular outer rim of the floating roof 14 is typically comprised of a plurality of spliced-together rim channel sections 280. An adjacent pair of the rim channel sections 280 are shown in FIGS. 38 and 39. Typically, the spliced-together rim channel sections are sealed to prevent the escape of vapors from the liquid product therethrough, such as by caulking or otherwise sealing the seam or joint between the adjacent rim channel sections. However, if the adjacent rim channel sections are not spliced together in secure fashion, so that relative movement therebetween is essentially prevented, eventually the caulking or other sealant becomes broken, and may even fall out so as to seriously impair the effectiveness of the seal.

Figure 40:
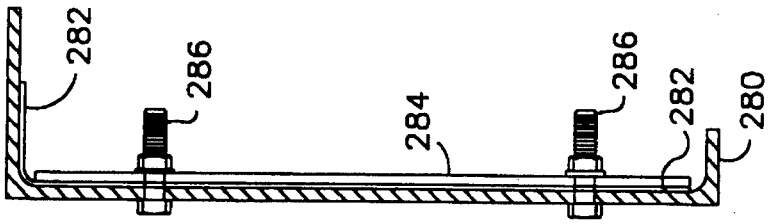
FIG. 40 is a side sectional view of the arrangement of FIG. 38 taken along the line 40—40 of FIG. 29.

A rim channel section splicing arrangement for avoiding the problems of the prior art is shown in FIGS. 38–40. As shown therein, the adjacent rim channel sections 280 are joined by a rim sealing angle 282, which spans the joint between the sections 280. The rim sealing angle 282, which extends between upper and lower flanges of the sections 280, is relatively thin and narrow, and serves primarily to provide some joinder of the adjacent sections 280. Principal joinder of the adjacent sections 280, however, is provided by a much larger and thicker rim splice plate 284. The rim splice plate 284 extends over the rim sealing angle 282, and is coupled in plural locations to each of the adjacent rim channel sections 280 by bolts 286. The relatively large and substantial rim splice plate 284, and the bolting thereof to relatively large areas of the adjacent rim channel sections 280 using the bolts 286, serves to substantially secure the adjacent rim channel sections 280 in a manner which discourages relative movement between the adjacent rim channel sections 280. The rim splice plate 284 is relatively wide, and at the same time extends between the upper and lower flanges of the sections 280. With the adjacent rim channel sections 280 so secured, the small space between such sections can be sealed such as by applying a quantity of caulk 288 thereto. The caulk 288 remains within and seals the small space between the adjacent rim channel sections 280, thereby preventing the escape of vapors through the curved outer rim of the floating roof to the atmosphere outside.

Figure 41:
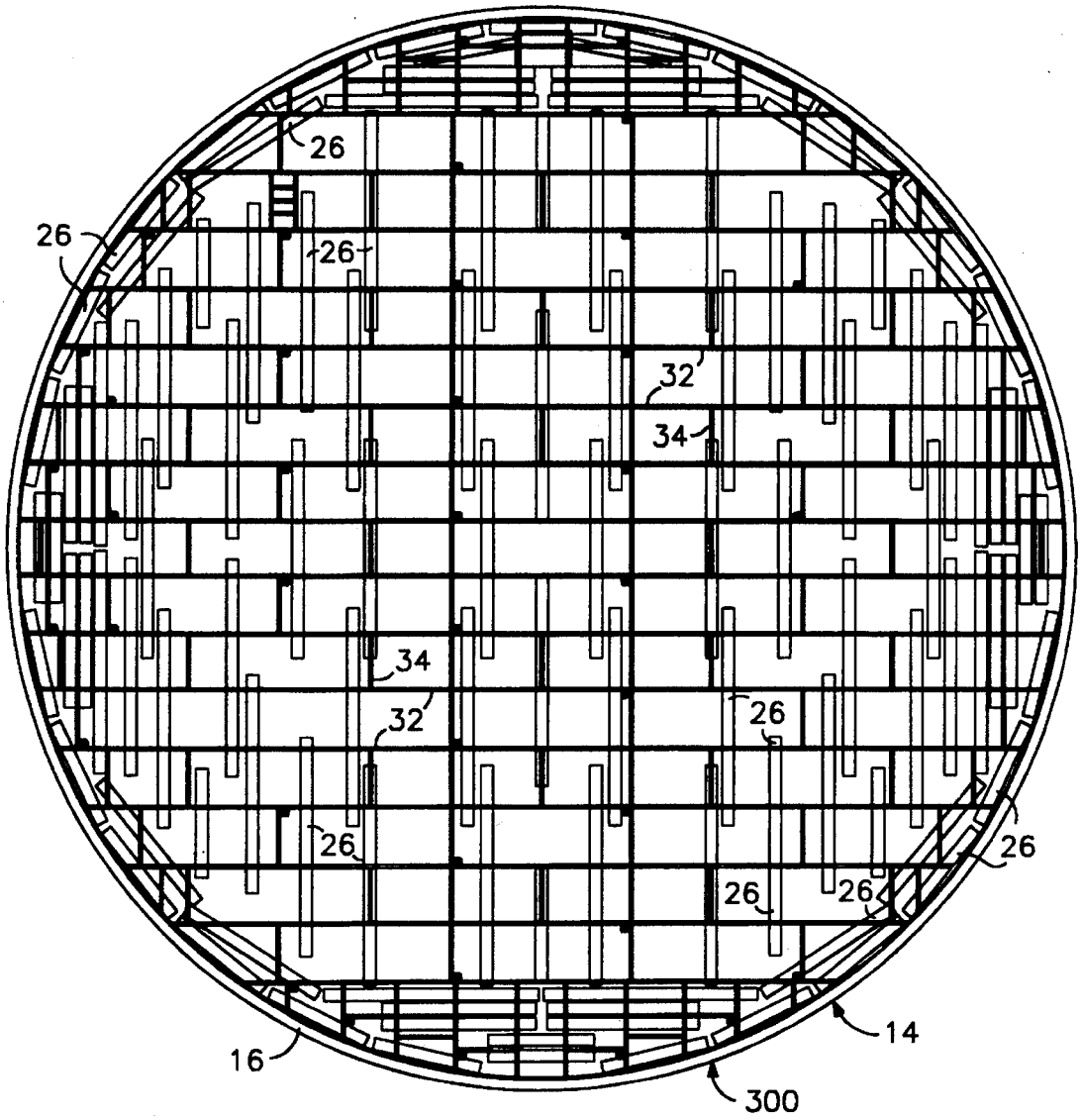
FIG. 41 is a top or plan view of a floating roof similar to FIG. 3 but showing pontoons mounted on and close to the outer rim of the floating roof.

FIG. 41 shows a floating roof 300 with the deck sheeting removed for clarity of illustration, in the manner of FIG. 3. Like the floating roof 14 of FIG. 3, the floating roof 300 of FIG. 41 has a frame 22 including a channel 30 forming an outer rim of the floating roof 300. The frame 22 includes a plurality of the main girders 32 and a plurality of the crossgirders 34, which are interconnected in the manner previously described. As in the case of FIG. 3, the floating roof 300 includes a plurality of the pontoons 26 extending transversely across and mounted on the main girders 32, in the manner previously described.

In addition to pontoons 26 extending transversely to the main girders 32, as in the case of the floating roof 14 of FIG. 3, the floating roof 300 of FIG. 41 has a plurality of the pontoons 26 mounted on the channel 30 and a plurality of the pontoons 26 mounted adjacent the perimeter of the floating roof 300 as defined by the channel 30. Those of the pontoons 26 which are mounted on the channel 30 may be coupled thereto using an arrangement such as that shown in FIGS. 32–34. Pontoons mounted adjacent the outer perimeter defined by the channel 30 may be mounted on the girders 32 and 34 at desired orientations using the arrangement shown in FIGS. 35–37. Mounting arrangements such as those shown in FIGS. 32–34 and in FIGS. 35–37 facilitate mounting some of the pontoons 26 at and close to the outer perimeter of the floating roof. This is particularly useful in cases where the weight of a roof seal mounted at the outer rim and other factors may require additional support of the roof adjacent the outer perimeter.

While the invention has been particularly shown and described with reference to a preferred embodiment thereof, it will be understood by those skilled in the art that other changes in form and details may be made therein without departing from the spirit and scope of the invention.

I claim:

1. An arrangement for coupling a pontoon to a floating roof in a storage tank for liquid product comprising a floating roof having a girder, a pontoon, a saddle and strap assembly for receiving and securing the pontoon therein, and a mounting plate attached to the girder of the floating roof and having a lower flange with an aperture therein for pivotally coupling the saddle and strap assembly thereto, the saddle and strap assembly including a saddle having an intermediate portion thereof between opposite ends and a strap having opposite ends attached to the opposite ends of the saddle, the intermediate portion of the saddle being coupled to the lower flange by a single, pivotable coupling extending through the aperture therein, so that the saddle and strap assembly can assume different angular orientations relative to the lower flange and thereby permit attachment of the mounting plate at any of a plurality of locations along the girder.

2. An arrangement in accordance with claim 1, wherein the single, pivotable coupling comprises a bolt.

3. An arrangement for coupling a pontoon to a floating roof in a storage tank for a liquid product comprising a floating roof, a pontoon, a saddle and strap assembly for receiving and securing the pontoon therein, and a mounting plate attached to the floating roof and having a lower flange, the saddle and strap assembly being coupled to the lower flange by a single, pivotable coupling, so that the saddle and strap assembly can assume different angular orientations relative to the lower flange, the floating roof including a girder having a grooved slot therein, and the mounting plate having a lateral flange opposite the lower flange which extends into the grooved slot and is attached to the girder by a threaded fastener extending through the mounting plate and into the grooved slot.

* * * * *